US005695671A

United States Patent [19]

Landwehr et al.

[11] Patent Number: 5,695,671

[45] **Date of Patent: *Dec. 9, 1997**

[54] SYSTEM AND PROCESS FOR CONTROLLING DIELECTRIC OVENS

[75] Inventors: Tim A. Landwehr, West Alexandria; Gary L. Mercer, Eaton; Joseph P. Miklos, Germantown, all of Ohio

[73] Assignee: Henney Penny Corporation, Eaton, Ohio

[ * ] Notice: The term of this patent shall not extend beyond the expiration date of Pat. No. 5,556,567.

[21] Appl. No.: 651,496

[22] Filed: May 22, 1996

Related U.S. Application Data

[63] Continuation of Ser. No. 239,524, May 9, 1994, Pat. No. 5,556,567.

[51] Int. Cl.[6] ..... H05B 6/50

[52] U.S. Cl. ..... 219/779; 219/771; 219/780; 99/358

[58] Field of Search ..... 219/771, 778, 219/779, 780, 718, 719, 666, 707; 99/451, 358, DIG. 14, 325; 426/244

[56] References Cited

U.S. PATENT DOCUMENTS

| | | | |
|---|---|---|---|
| 2,415,799 | 2/1947 | Reifel et al. | 219/779 |
| 2,474,420 | 6/1949 | Himmel . | |
| 2,504,955 | 4/1950 | Atwood | 219/779 |
| 2,512,311 | 6/1950 | Davis . | |
| 2,542,589 | 2/1951 | Stanton et al. . | |
| 3,082,710 | 3/1963 | Holland . | |
| 3,591,751 | 7/1971 | Goltsos . | |
| 3,866,255 | 2/1975 | Serota . | |
| 4,010,341 | 3/1977 | Ishammar . | |
| 4,221,950 | 9/1980 | Lamberts et al. | 219/779 |
| 4,296,298 | 10/1981 | MacMaster et al. . | |
| 4,303,820 | 12/1981 | Stottmann et al. . | |
| 4,406,070 | 9/1983 | Preston | 219/779 |

FOREIGN PATENT DOCUMENTS

| | | |
|---|---|---|
| W812947 | 12/1989 | European Pat. Off. . |
| 3205124 | 8/1983 | Germany . |

(List continued on next page.)

*Primary Examiner*—Philip H. Leung
*Attorney, Agent, or Firm*—Baker & Botts, L.L.P.

[57] ABSTRACT

A control system for controlling the heating of a product in a dielectric oven comprises at least one dielectric heating circuit including an electromagnetic energy source, such as a triode vacuum tube, having an anode and a resonant circuit including at least one inductor and at least a pair of capacitors. Each capacitor includes two capacitor plates and one of these capacitor plates is moveable, such that each pair of capacitors forms a variable capacitor in which the product to be heated is a dielectric. The system also includes at least one ammeter for measuring actual anode current at the anode. A motor is used to increase or decrease a distance between the plates of at least one of said capacitors, thereby adjusting the electromagnetic energy delivered to the product. A processor receives ammeter measurements, whereby the distance between the pair of capacitor plates is adjusted to increase or decrease the actual anode current. The processor also receives, stores, and retrieves a requested anode current and compares the requested anode current to the actual anode current to determine whether to increase or decrease the distance between the pair of capacitor plates. Alternatively, the electromagnetic energy source may have a duty cycle adjusted by a keying circuit or an anode voltage adjusted by a voltage control device, or both. The processor may include a timer, whereby an average actual anode current is measured. The processor may receive, store, and retrieve a requested average anode current and compares this current to the actual average anode current to adjust the electromagnetic field electrically by either increasing or decreasing the duty cycle or increasing or decreasing the anode voltage of the electromagnetic energy source, or both, and thereby increase or decrease the average actual anode current.

41 Claims, 12 Drawing Sheets

U.S. PATENT DOCUMENTS

| | | | |
|---|---|---|---|
| 4,420,670 | 12/1983 | Croswell et al. | 219/779 |
| 4,507,531 | 3/1985 | Teich et al. | 219/718 |
| 4,522,834 | 6/1985 | Miyahara . | |
| 4,812,609 | 3/1989 | Butot | 219/771 |
| 4,900,885 | 2/1990 | Inumada | 219/718 |
| 4,978,826 | 12/1990 | DeRuiter et al. | 219/771 |
| 4,980,530 | 12/1990 | Butot | 219/771 |
| 5,274,208 | 12/1993 | Noda . | |
| 5,512,737 | 4/1996 | Miklos | 219/771 |
| 5,556,567 | 9/1996 | Landwehr et al. | 219/779 |

SYSTEM AND PROCESS FOR CONTROLLING DIELECTRIC OVENS

This application is a continuation of application Ser. No. 08/239,524, filed May 9, 1994 U.S. Pat. No. 5,556,567 entitled "SYSTEM AND PROCESS FOR CONTROLLING DIELECTRIC OVENS".

BACKGROUND OF THE INVENTION

1. Field of the Invention

This invention relates to systems and processes for controlling the heating of a product, such as cooing foodstuffs, in a dielectric oven. Further, it relates to systems and processes for controlling dielectric ovens having multiple support levels for heating commercial quantities of the product. Particularly, it relates to systems and processes for controlling the current flow within capacitor plates which produce an electromagnetic field providing electromagnetic energy to the product.

2. Description of the Related Art

Commercial ovens are colony convection ovens utilizing a slow convection heating process to heat products. Dielectric ovens, however, heat a product due to the electric, i.e., dielectric, losses caused when the product is placed in a varying electromagnetic field. If the product is homogeneous and the electromagnetic field is uniform, heat may develop uniformly and simultaneously throughout the mass of the product.

Dielectric ovens are known, and examples of such ovens are disclosed in U.S. Pat. Nos. 4,812,609 to Butot; 4,978,826 to DeRuiter et al.; and 4,980,530 to Butot, which are incorporated herein by reference. Such ovens may operate in a frequency range of 2 to 40 Mhz. Referring to FIG. 1*a*, a dielectric oven 200 may be fitted with guide racks 202 for stacking a plurality of trays 204 carrying a product 206 to be heated. These racks 202 also may function as electrodes for producing an electromagnetic field. A variable air capacitance 212 is created between tray 204 containing product 206 and electrodes 202 to control the electromagnetic energy applied to product 206.

Dielectric ovens may utilize an oscillating circuit or circuits having specially designed electromagnetic energy sources, such as power tubes. Such energy sources may be coupled and supply current to guide rack electrodes 202 via contacts 205 which project through an oven housing 209 into heating cavity 208. The oscillating circuit(s) generally provide a substantially fixed distribution of voltage and power within a heating cavity. Thus, longer heating times may be required for heating greater quantities of products. Further, frequencies at which the ovens are operated are dependent on the characteristics of the product being heated.

Referring to FIG. 1*b*, although dielectric ovens 200' may handle a plurality of vertically stacked trays 204', which permit products 206' to be heated at multiple levels 210' within a single heating cavity 208', only a single pair of electrodes 202' may be provided to apply the electromagnetic energy for heating. Thus, when a number of different heating levels 210' are used, the amount of energy applied to product 206' in each tray 204' may be reduced, and heating may take longer. As discussed above, electromagnetic energy sources may be coupled and supply current to electrodes 202' via contacts 205' which project through an oven housing 209' into a heating cavity 208'. A variable air capacitance 212' may be created between tray 204' (and product 206') and electrodes 202' to control the energy applied to product 206'.

A dielectric oven may include a heating cavity for receiving a tray containing the product, an electromagnetic energy source; oscillating circuit for producing an electric signal, and an electrode configuration for producing an electromagnetic field in the cavity to apply energy from the oscillating circuit to the product. Such ovens are broadly operable for increasing the energy applied from the oscillating circuit to the product, without increasing the operating voltage of the electromagnetic energy source or the frequency of its operation. These ovens may include a plurality of oscillating circuits having substantially similar resonant frequencies.

The oscillating circuits may receive power from a power tube in order to establish respective oscillating signals. More particularly, at least first and second oscillating circuits may be provided, and the electrode configuration may include at least first and second electrodes, each of which is a component of one of the at least two oscillating circuits. The product may be bracketed between electrodes of a capacitor in the oscillating circuit. The oscillating circuit is arranged to provide a voltage across the capacitor which is twice the voltage across the power source, thus permitting doubling of distance between the electrodes of the capacitor without reducing the electromagnetic field strength and increasing of quantities of the product which may be heated between the capacitor electrodes.

Each of the oscillating circuits may also include an inductance and a capacitance. The capacitance includes a pair of capacitors respectively formed between two capacitor plates, i.e., the electrodes of the oscillating circuit, and another pair of plates, for example, wall portions of the heating cavity. The two electrodes of each oscillating circuit may be oriented to produce an open electromagnetic field between them. In this configuration, electrode pairs form a pair of interconnecting load capacitors between the electrodes of the oscillating circuits. The dielectric of the load capacitors includes the product placed between the electrodes of the capacitors, i.e. within the capacitance.

This configuration produces an open electromagnetic field between the electrodes of each of the pair of interconnecting (load) capacitors. The open electromagnetic field has a power intensity distribution determined by the dielectric characteristics of the product, while permitting the electromagnetic energy source to operate at a substantially constant power level. Further, the use of the load capacitors as connectors between the oscillators isolates the frequency of oscillation of the oscillating circuits from the effects of the dielectric characteristics of the product. Thus, both the power intensity and the frequency of the power transferring signals are maintained more nearly constant, with reduced variations caused by the dielectric characteristics of the product being heated.

A variable air capacitance or air "gap" may be included between the electrodes of the interconnecting capacitors and the product for controlling the energy applied to the product between the load capacitors. See FIGS. 1*a* and 1*b*. Nevertheless, such a variable air "gap" may interfere with the rapid insertion and removal of trays containing products for heating. Further, because of the speed with which products may be heated in a dielectric oven, manual control of the dielectric oven may be difficult and inefficient. Because heating may include the thawing and cooking of frozen foodstuffs, accurate control of the oven prevents uneven or inadequate heating.

SUMMARY OF THE INVENTION

Thus, a need has arisen for a more efficient system for controlling the heating of a product in a dielectric oven. It is an object of this invention that a variable capacitor is adjusted to control the electromagnetic field produced by the heating circuit and, thereby, to control the heating of the product. It is a feature of this invention that the capacitance may be mechanically adjusted by varying the distance between capacitor plates, e.g., a pair of capacitor plates whereby the strength of the electromagnetic field between the plates is adjusted. It is also a feature of this invention that the average current supplied to the plates during the heating cycle may be adjusted electrically, either by varying the grid voltage supplied to the generator or by varying the anode voltage supplied to the generator. The electrical and mechanical methods of adjustment may be combined to control the electromagnetic field produced by the dielectric circuit. It is a particular advantage of embodiments employing electrical adjustment of the power delivered to the food product that fewer moving parts are used than in a mechanically adjusted system or a system combining electrical and mechanical adjustment. Further, an electrical adjustment system is generally more reliable and easier to manufacturer and maintain.

It is yet another object of this invention that sensors may directly measure the temperature of the product within the electromagnetic field. It is an advantage of this invention that the sensor(s) may measure the temperature of the product while it is being heated to permit constant monitoring of the performance of the dielectric oven. It is a feature of this invention that the progress of the product's heating, e.g., product temperature, may be measured by means of an infrared sensor or by passing a fluid-filled tube through the product and measuring the temperature change in the fluid. A suitable fluid has a low dielectric loss constant, but relatively high thermal conductivity, such as oil or air, so that the fluid is heated by the product, rather than the electromagnetic field produced in the oven.

It is still another object of this invention that the sensors may indirectly measure the heating of the product within the electromagnetic field. Again, it is an advantage of this invention that the sensor(s) may measure the temperature of the product while it is being heated to permit constant monitoring of the performance of the dielectric oven. It is a feature of this invention that the progress of the product's heating may be measured by determining the temperature or humidity difference between air drawn into the oven and air exhausted from the oven.

An embodiment of the invention is a control system for controlling the heating of a product in a dielectric oven. The control system comprises at least one dielectric heating circuit including an electromagnetic energy source, such as a triode vacuum tube, having an anode. The system also comprises a resonant circuit including at least one inductor and at least a pair of capacitors, wherein each capacitor includes two capacitor plates and at least one of the capacitor plates is moveable. Each pair of capacitors forms a variable capacitor in which the product to be heated is a dielectric. At least one ammeter measures the actual current at the anode. A motor increases or decreases a distance between the plates of at least one of the capacitors, thereby adjusting the electromagnetic energy applied to the product. A processor, such as a microprocessor, receives ammeter measurements, whereby the distance between the pair of capacitor plates is determined, and receives, stores, and retrieves a requested anode current. The processor also compares the requested anode current to the actual anode current to determine whether to increase or decrease the distance between the plates of at least one of the capacitors, thereby increasing or decreasing the actual anode current, and instructs the motor to adjust the distance between the plates.

In another embodiment, a control system controls the heating of a product in a dielectric oven. The system comprises at least one dielectric heating circuit including an electromagnetic energy source having an anode and a selectable duty cycle and a resonant circuit including at least one inductor and at least a pair of capacitors, wherein each capacitor includes two capacitor plates. Each pair of capacitors forms a variable capacitor in which the product to be heated is a dielectric. At least one ammeter measures an actual current at the anode. A keying device, such as a grid block keyer, adjusts the duty cycle. A processor includes a timer and receives ammeter measurements, whereby the actual average anode current is determined. It also receives, stores, and retrieves a requested average anode current; compares the requested average anode current to the actual average anode current to determine whether to increase or decrease the duty cycle, thereby increasing or decreasing the actual average anode current; and instructs the keying device to adjust the duty cycle.

In a third embodiment, a control system controls the heating of a product in a dielectric oven. The system comprises at least one dielectric heating circuit including an electromagnetic energy source having an anode and a resonant circuit including at least one inductor and at least a pair of capacitors, wherein each capacitor includes two capacitor plates. Each pair of capacitors forms a variable capacitor in which the products to be heated are a dielectric. At least one ammeter measures an actual current at the anode. A voltage control device, such as a motorized variac or a triac, controls a first voltage provided to a power supply, such as a transformer, which provides a second or anode voltage at the anode of the electromagnetic energy source. A processor includes a timer and receives ammeter measurements whereby the actual average anode current is determined. It also receives, stores, and retrieves a requested average anode current, compares the requested average anode current to the actual average anode current to determine whether to increase or decrease the second or anode voltage, thereby increasing or decreasing the actual average anode current, and instructs the voltage control device to vary the first voltage to the power supply.

In still another embodiment of the invention, the control system may comprise a combination of the components of the embodiments described above.

A further embodiment of the invention is a process for controlling the heating of a product in a dielectric oven comprising a processor, an electromagnetic energy source, such as a triode vacuum tube, having an anode, and a resonant circuit including at least one inductor and at least a pair of capacitors. Each of the capacitors has a pair of capacitor plates, and the product is located between at least said pair of capacitors. The process comprises the steps of requesting an anode current and measuring an actual anode current. Further, it comprises the steps of comparing the requested anode current to the actual anode current to determine whether to increase or decrease a distance between at least one pair of capacitor plates, thereby increasing or decreasing the actual anode current, and adjusting the distance between the at least one pair of capacitor plates.

In another embodiment of the process of this invention, a process for controlling the heating of a product in a dielectric oven comprises a processor, an electromagnetic energy source having an anode and a selectable duty cycle, and a resonant circuit including at least one inductor and at least a pair of capacitors. Each of said capacitors has a pair of capacitor plates, and the product is located between at least said pair of capacitors. The process comprises the steps of measuring an anode current, selecting a duty cycle for the electromagnetic energy source, and determining an actual average anode current and a requested average anode current. Further, the process comprises the steps of comparing the requested average anode current to the actual average anode current to determine whether to increase or decrease the duty cycle, thereby increasing or decreasing the actual average anode current, and adjusting the duty cycle.

In yet another embodiment of the process of this invention, a process for controlling the heating of a product in a dielectric oven comprises a processor, an electromagnetic energy source having an anode and a resonant circuit having at least one inductor and at least a pair of capacitors. Each of said capacitors has a pair of capacitor plates, and the product is located between at least said pair of capacitors. The process comprises the steps of measuring an anode current, selecting an anode voltage for the electromagnetic energy source, and determining an actual average anode current and a requested average anode current. Further, the process comprises the steps of comparing the requested average anode current to the actual average anode current to determine whether to increase or decrease the anode voltage, thereby increasing or decreasing the actual average anode current, and adjusting the anode voltage.

The process may also include a combination of the adjustment of the distance between capacitor plates and the adjustment of the duty cycle or anode voltage, or both, to increase or decrease the electromagnetic field strength. Although various combinations of these steps are possible, in at least one embodiment, larger variations in energy applied to the product are accomplished by changing the position of the capacitor plates while smaller variations of energy applied to the product are accomplished by adjusting the duty cycle or anode voltage.

Other objects, advantages, and features will be apparent when the detailed description of the invention and the drawings are considered.

DETAILED DESCRIPTION OF THE INVENTION

Figure 1A:
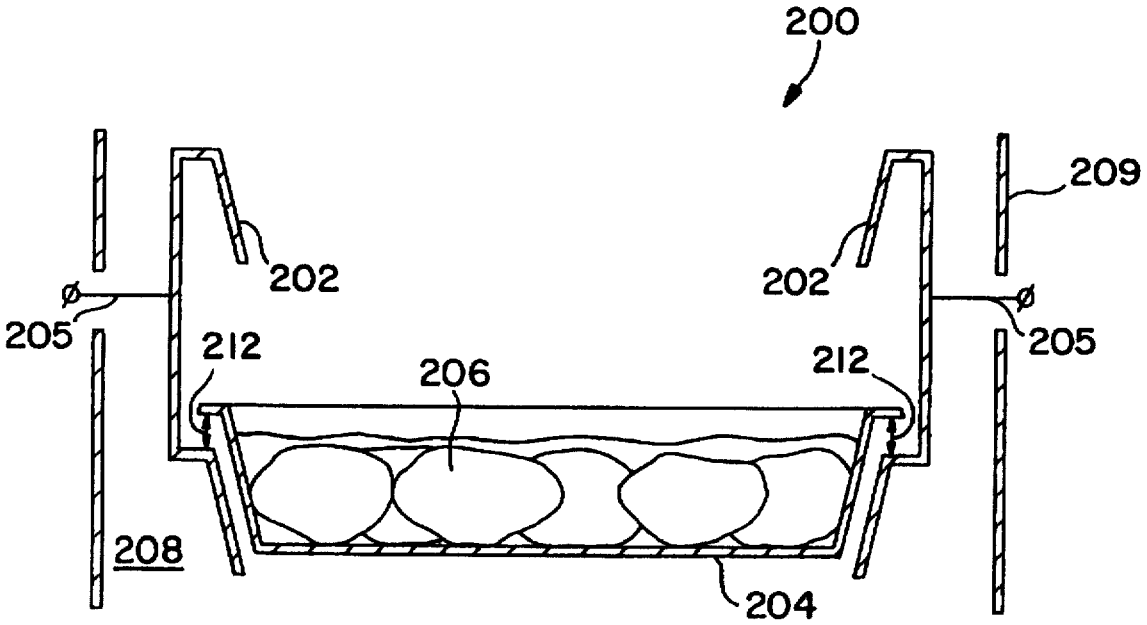
FIG. 1a PRIOR ART
FIG. 1*a* depicts a dielectric oven in which trays are supported by an electrode configuration and which has a plurality of levels and employs a variable air gap for controlling electromagnetic energy applied to the product.
Figure 1B:
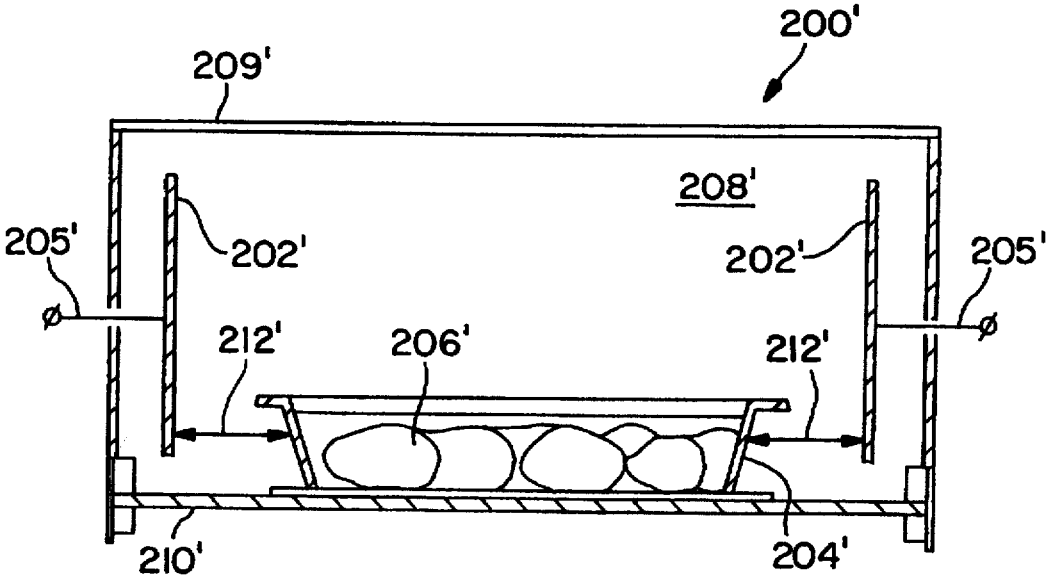
FIG. 1b PRIOR ART
FIG. 1*b* depicts a dielectric oven in which trays are positioned between two electrodes on a moveable support and which also employs a variable air gap for controlling electromagnetic energy applied to the product.
Figure 2:
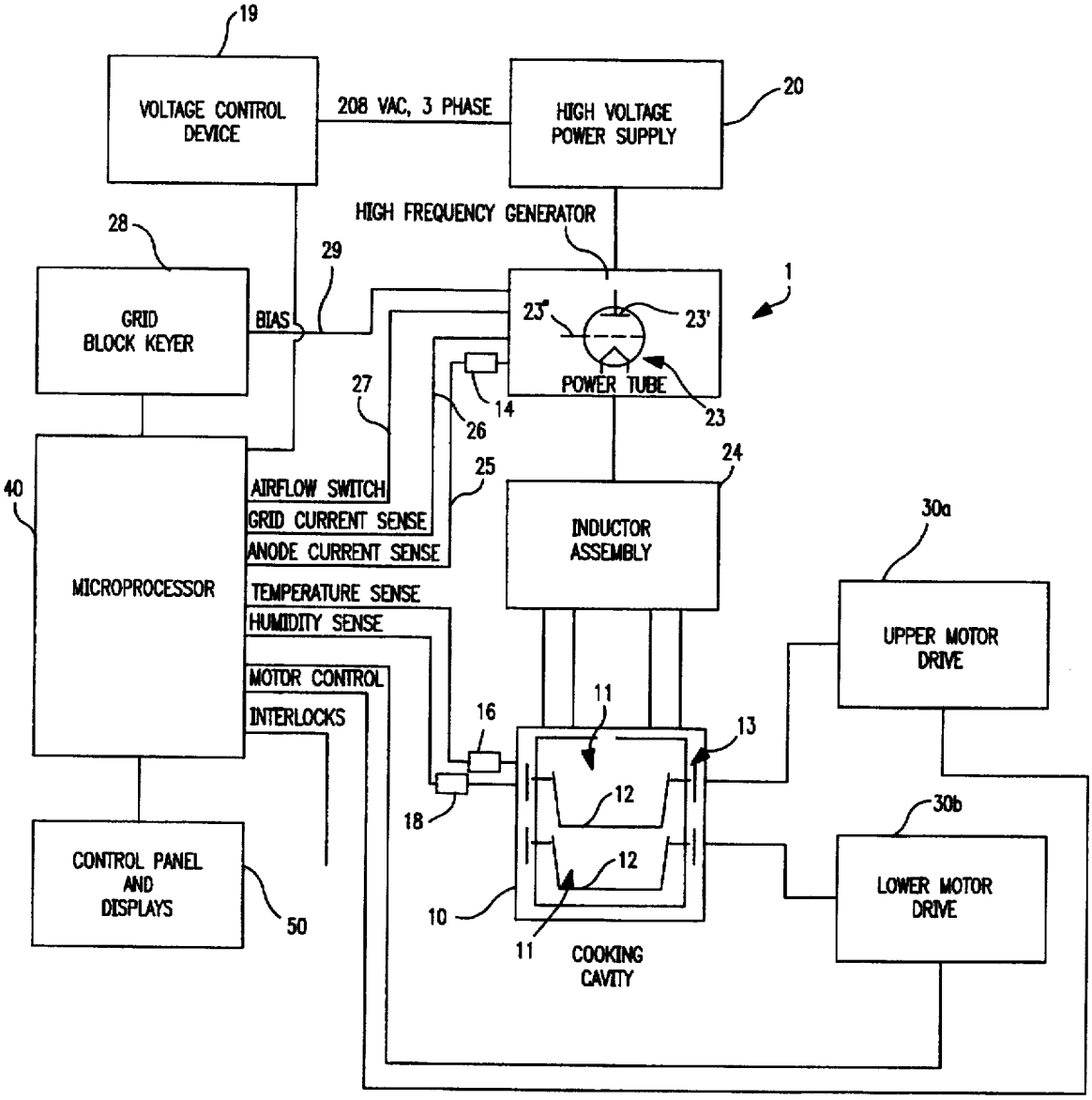
FIG. 2 is a schematic representation of an embodiment of the control system including mechanical and electrical capacitance adjusting components.

Referring to FIG. 2, a schematic diagram of a preferred embodiment of the control system 1 is depicted. Control system 1 is comprised of a dielectric oven 10 which may receive a plurality of product trays 12. Each of product trays 12 is placed in an oven cavity 11 and between a pair of capacitors 13. The electrodes (not shown) thus produce an electromagnetic field providing energy from a electromagnetic, high frequency generator 22 to the food product (not shown) in product tray 12.

Figure 3:
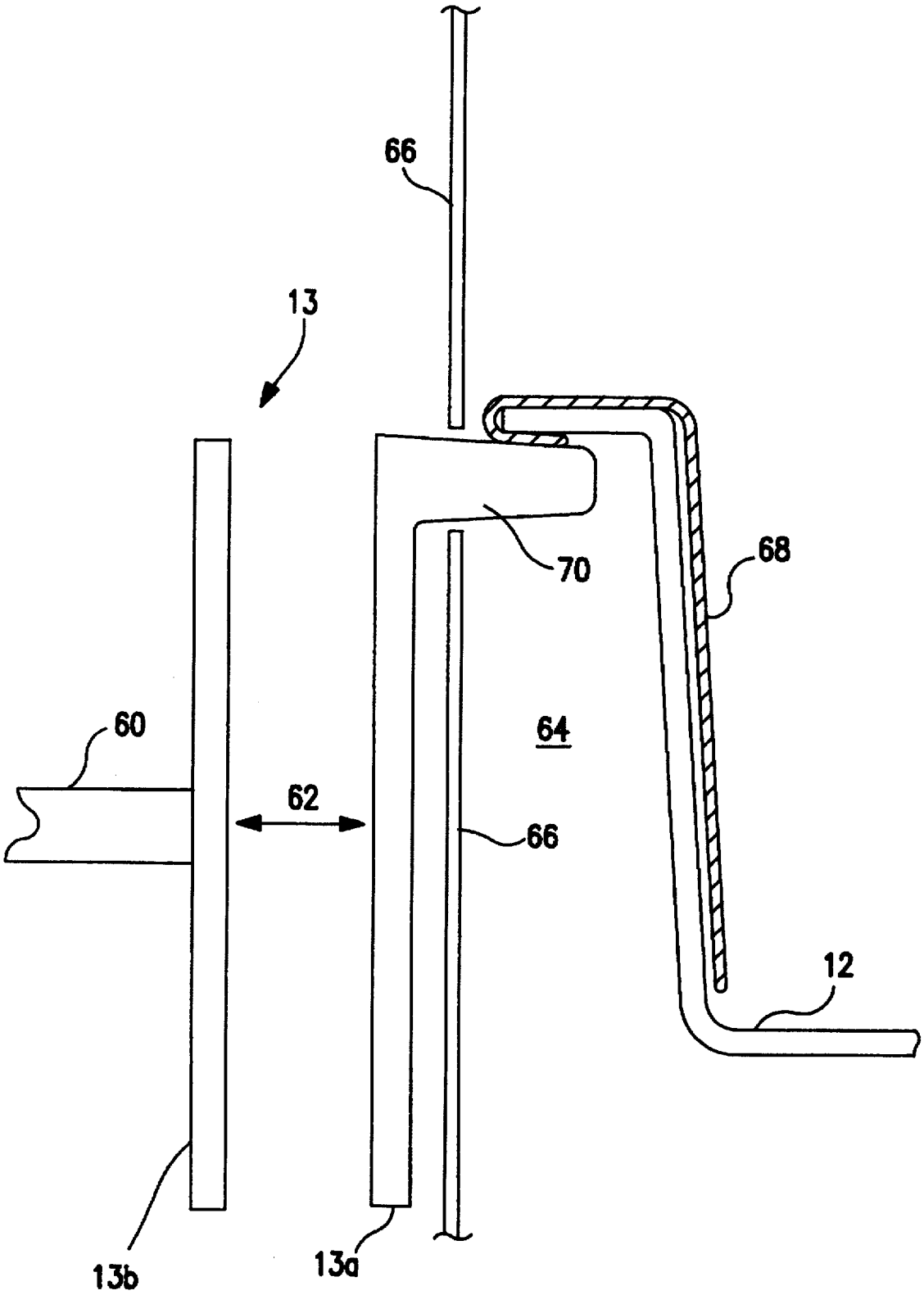
FIG. 3 is a cross-sectional view of a capacitor having two capacitor plates and a partial cross-sectional view of a product tray with a removable electrode mounted on the tray.

Referring to FIG. 3, each of capacitors 13 is formed by a pair of capacitor plates 13*a* and 13*b*. At least one of capacitor plates 13*a* or 13*b* is moveable. For example, plate 13*b* may be attached to a positioning bar 60. Bar 60 may move plate 13*b* forward to reduce the separation 62 of plates 13*a* and 13*b*, i.e., increase the capacitance and increase the energy applied to the product, or its movement may be reversed to increase separation 62 of plates 13*a* an 13*b*, i.e., decrease the capacitance and reduce the energy applied to the product. In the embodiment depicted in FIG. 3, capacitor plates 13*a* and 13*b* are substantially outside of an oven cavity 64 and are separated from cavity 64 by an oven liner 66 fabricated from a material with a low dielectric loss constant, such as a polyester or polycarbonate resin. The electromagnetic field (not shown) is produced between a pair of electrodes 68 mounted on product tray 12 (only one shown), wherein each electrode 68 is electrically connected to a plate 13*a* by, for example, a contact 70. Contact 70 passes through liner 66 and into cavity 64. Product tray 12 is also fabricated from a material with a low dielectric loss constant, such as a polyester or polycarbonate resin, and in another embodiment, product tray 12 may be supported by an electrode extending from plate 13*a*.

Referring again to FIG. 2, a voltage control device 19 supplies a first voltage to a high voltage power supply 20 which provides or second or anode voltage, e.g., 5500 volts DC, to electromagnetic, high frequency generator 22 comprised of a triode vacuum tube 23 and associated resonant circuitry. Generator 22 operates at a frequency determined by the resonant circuit including inductor assembly 24 and capacitors 13. At least one ammeter measures current at an anode 23' in generator 22 which is an indirect measure of the power delivered between capacitor plates 13*a* and 13*b*.

Figure 4:
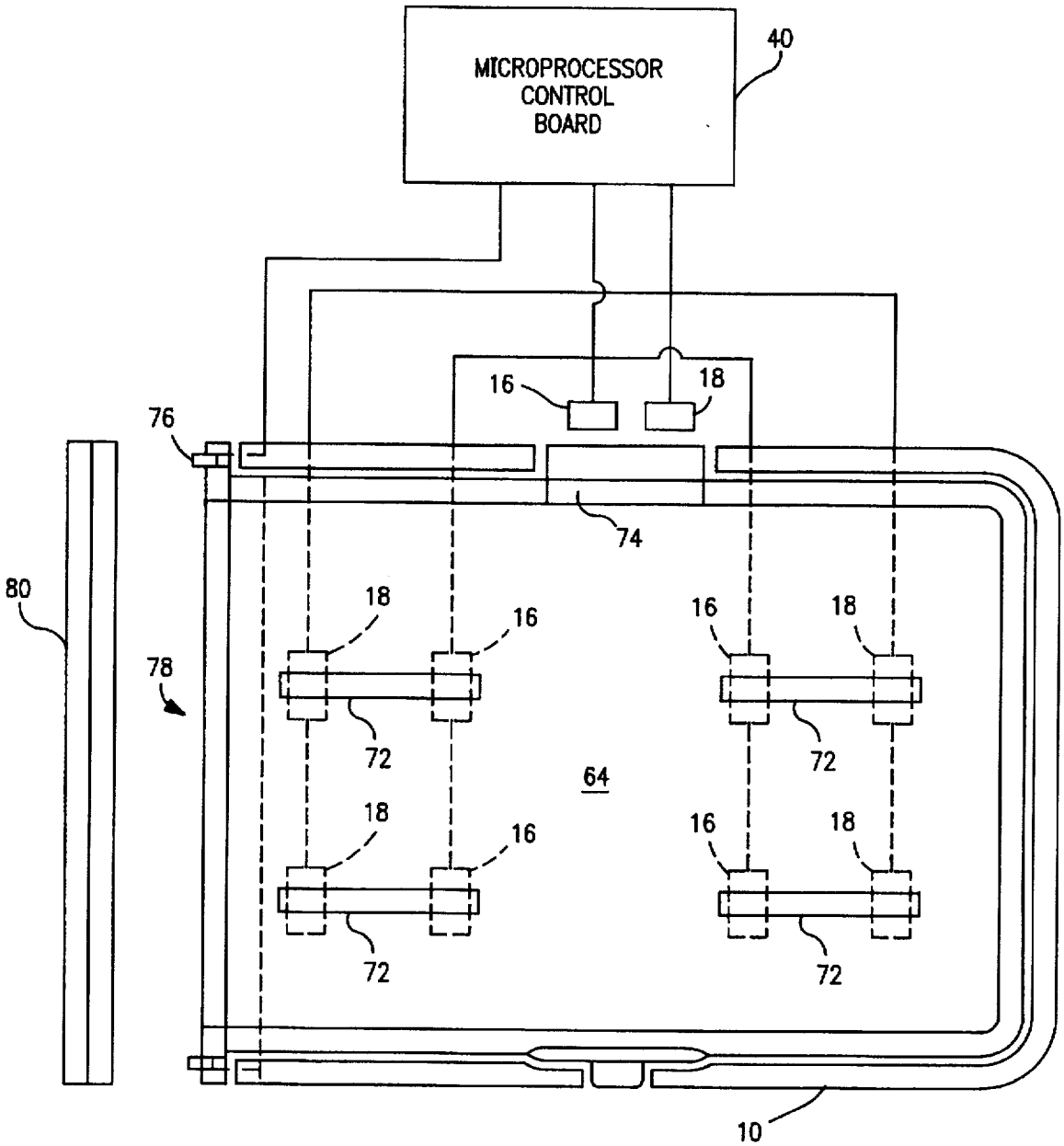
FIG. 4 is a cross-sectional view of an oven and an oven access depicting temperature and humidity sensors and oven interlocks.

Referring to FIG. 4, a dielectric oven includes oven cavity 64. Oven cavity 64 may have air intake ports 72 and at least one air exhaust port 74. As shown in FIGS. 2 and 4, at least one temperature sensor 16 may measure the temperature difference between air entering intake ports 72 and exiting exhaust port 74 or the temperature change over time (e.g., $\Delta T$) at, for example, exhaust port 74, or both. Intake ports 72 and exhaust ports 74 may be equipped with intake and exhaust fans (not shown), respectively, to improve ventilation within oven 10. Further, at least one humidity sensor 18 may measure the difference between the humidity of air entering intake ports 72 and exiting exhaust port 74 or the humidity change over time (e.g., $\Delta H$) at, for example, exhaust port 74, or both. By measuring temperature or humidity, or both, in this way, it is possible to monitor oven performance. For example, the humidity difference between air entering intake port 72 and air exiting exhaust port 74 or the humidity change over time in air exiting exhaust port 74 is an indication of the progress of the heating of the product, such as a foodstuff. The difference in air temperature or humidity, or both, may be attributed to dielectric losses in the product or water vapor, e.g., steam, produced during heating of the product. Further, if the product is heated in a heating liquid, e.g., water, product heating may be monitored by determining the temperature of the heating liquid or the vapor, e.g., steam, present in the oven or in the air exhausted from the oven as a result of the heating of the heating liquid.

During the early phases of heating, the humidity in the exhaust air will increase. Eventually, however, humidity released from the product will stabilize and decline. The measurements obtained by temperature sensor 16 or humidity sensor 18, or both, are transmitted to a microprocessor control board 40. Further, as depicted in FIG. 4, interlocks 76 may be located around an access 78 to oven 10, so that when access cover 80 seals access 78, interlocks 76 are closed and a closure signal is sent to control board 40. Because of dangers in the dielectric heating of products and the possible leakage of electromagnetic energy from the dielectric oven, it is preferable that the oven be equipped with interlocks 76 to prevent its operation, e.g., prevent the flow of current from generator 22 to one of capacitor plates 13*a* or 13*b*, when oven access 80 is open.

As discussed above, generator 22 has a selectable duty cycle. A duty cycle is the ratio of working time to total time for an intermittently operating device. It may be expressed as a percentage. For example, if the total time for one cycle is one second and generator 22 supplies current for 0.33 seconds during that cycle, generator 22 has a 33 percent duty cycle. This duty cycle is adjusted by a grid block keyer 28, and keyer 28 is controlled by control board 40 to adjust the duty cycle of generator 22. Keyer 28 may key the dielectric heating circuit by applying negative grid bias 29 at several times the cutoff value to the grid of a power tube 23' during key up conditions. For example, when the key is down, the blocking bias is removed, and normal current flows through the keyed circuit.

As previously discussed, voltage control device 19 is connected in series with the available line voltage and the primary windings of power supply 20. Signals generated by microprocessor 40 instruct voltage control device 19 to adjust the amplitude of voltage delivered to power supply 20, whereby the anode voltage delivered to anode 23' of power tube 23 is varied.

In addition to temperature and humidity data, microprocessor control board 40 also receives anode current measurements 25 transmitted from ammeter 14 and generator 22. Microprocessor control board 40 also senses the grid current 26 in generator 22 and senses the state 27 of and controls the intake fan(s) and the exhaust fan(s) (not shown) by controlling the flow of current from generator 22.

The separation 62 of capacitor plates 13*a* and 13*b* (see FIG. 3) is adjusted by means of motors, such as upper motor 30*a* and lower motor 30*b*. Such motors receive adjustment instructions from microprocessor control board 40 and supply feedback on their operation to microprocessor control board 40. Motors 30*a* and 30*b* may be powered by current supplied from an alternative power source (not shown).

Product identification, product heating parameters, and operational safety limits may be input to microprocessor control board 40 from a control panel and displays 50. Control panel and displays 50 may include various means for inputting information including a keyboard, a touch pad, a touch screen, a bar code reader, or the like. Information input to microprocessor control board 40 may be received by, stored in, and retrieved from storage components, such as RAMs or EPROMs. Control panel and displays 50 may also be used to review heating performance sensor measurements received by microprocessor control board 40 and to monitor the operation of keyer 28 and motors 30*a* and 30*b*. Control panel and displays 50 may further be used to monitor the status of interlocks 76.

Figure 7A:
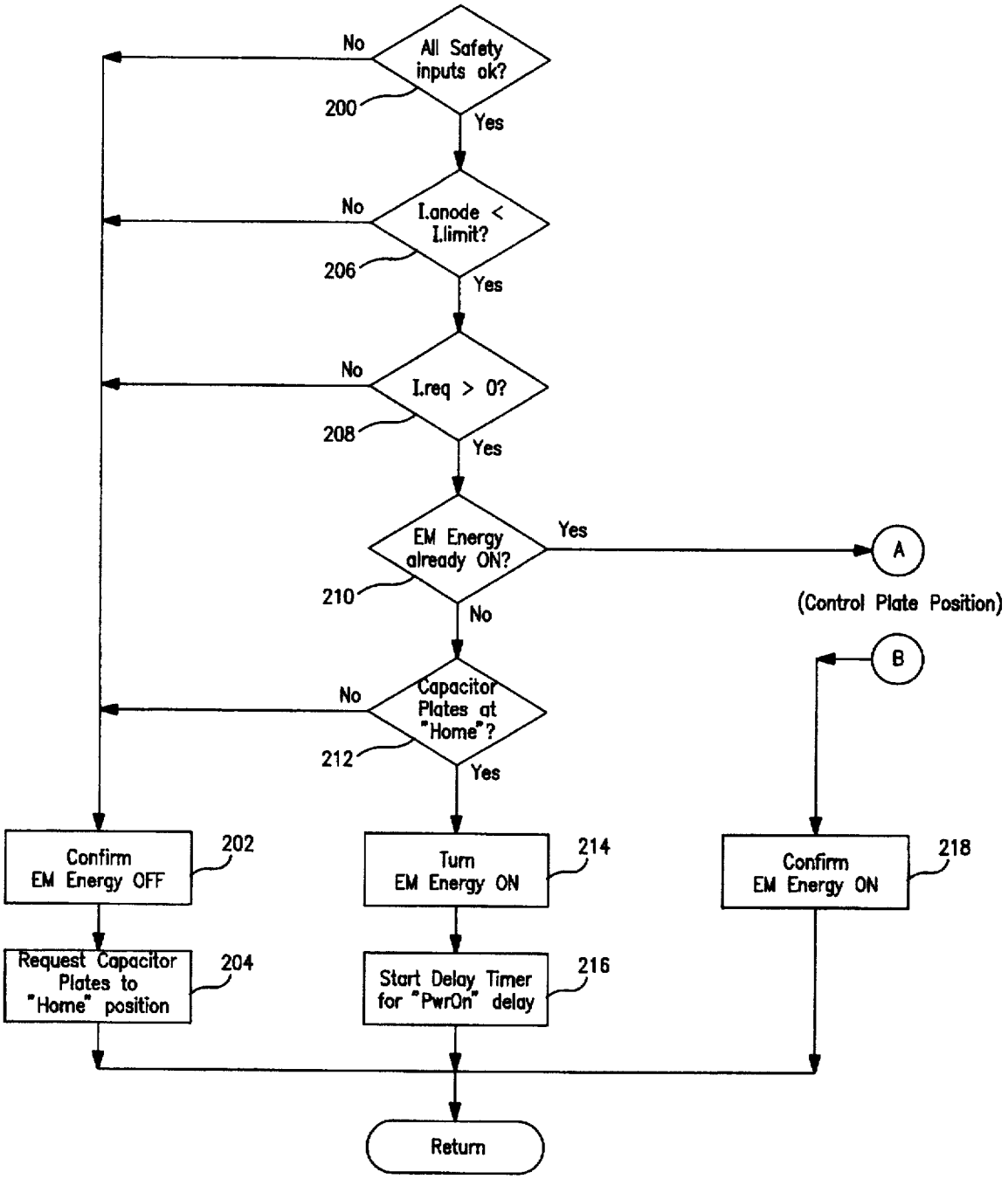
FIGS. 7*a* and 7*b* are flow charts depicting a process for controlling the electromagnetic field strength in a dielectric oven using moveable capacitor plates.
Figure 7B:
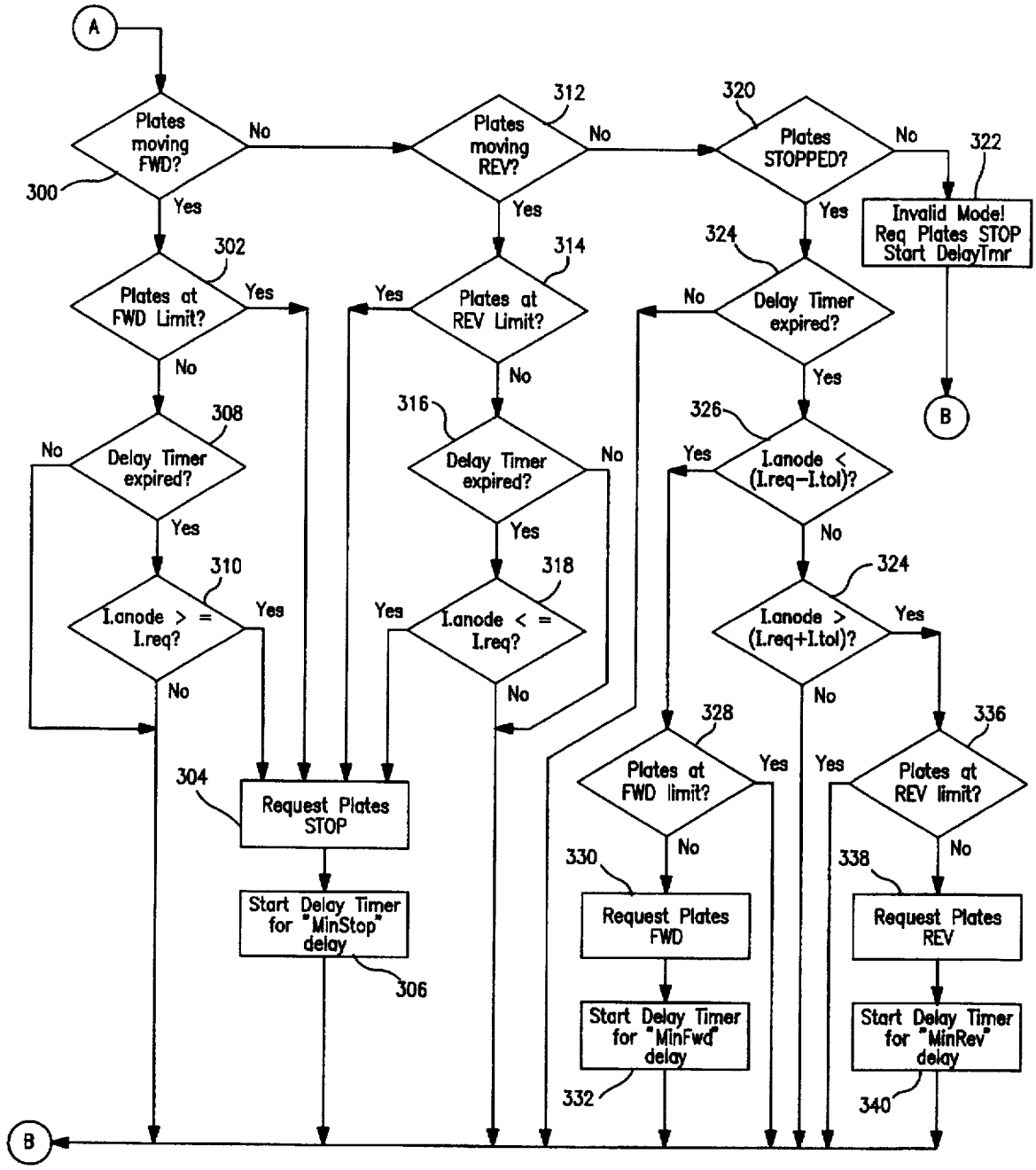
Figure 8A:
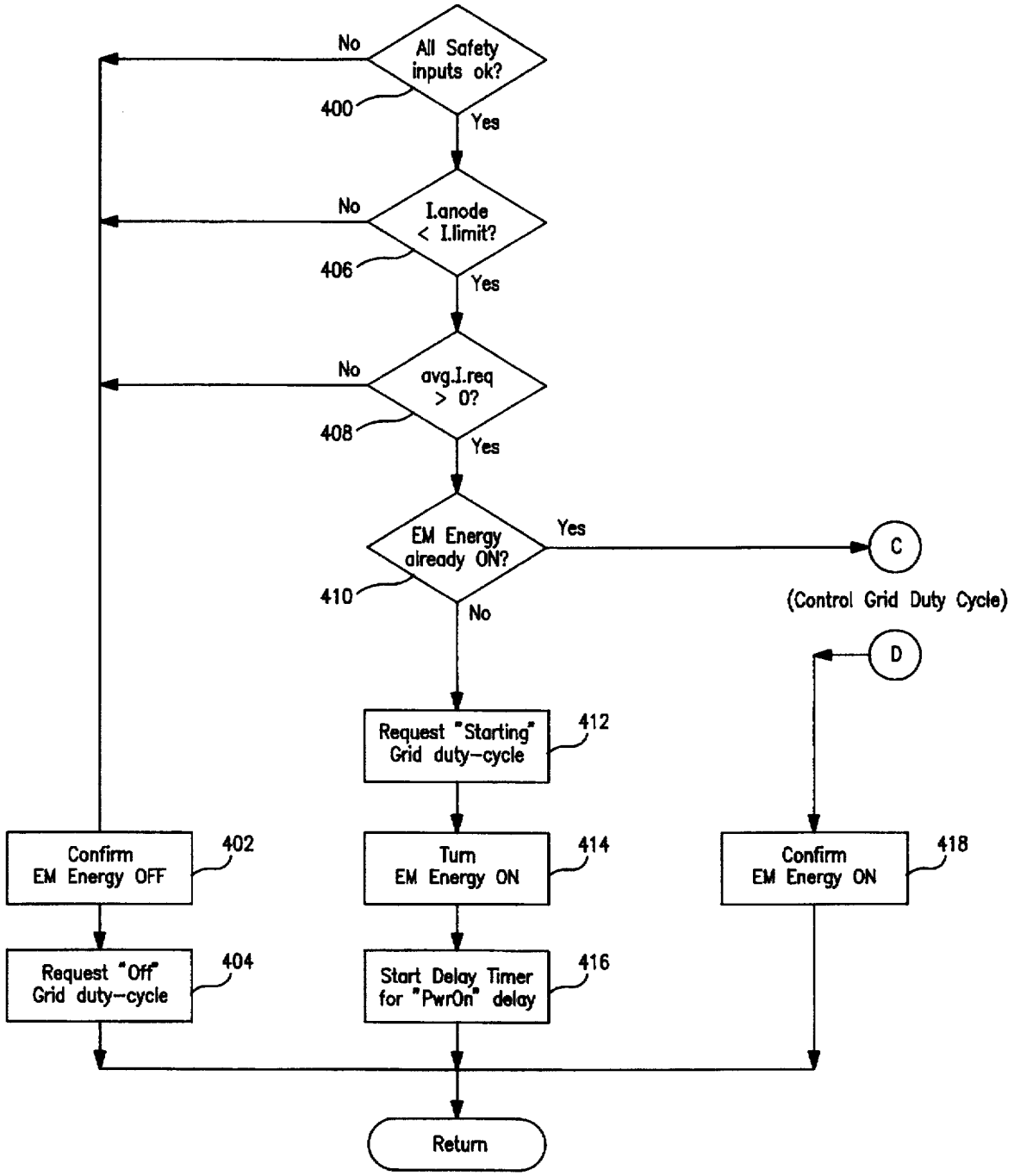
FIGS. 8*a* and 8*b* are flow charts depicting a process for controlling the electromagnetic field strength in a dielectric oven using duty-cycled grid blocking.
Figure 8B:
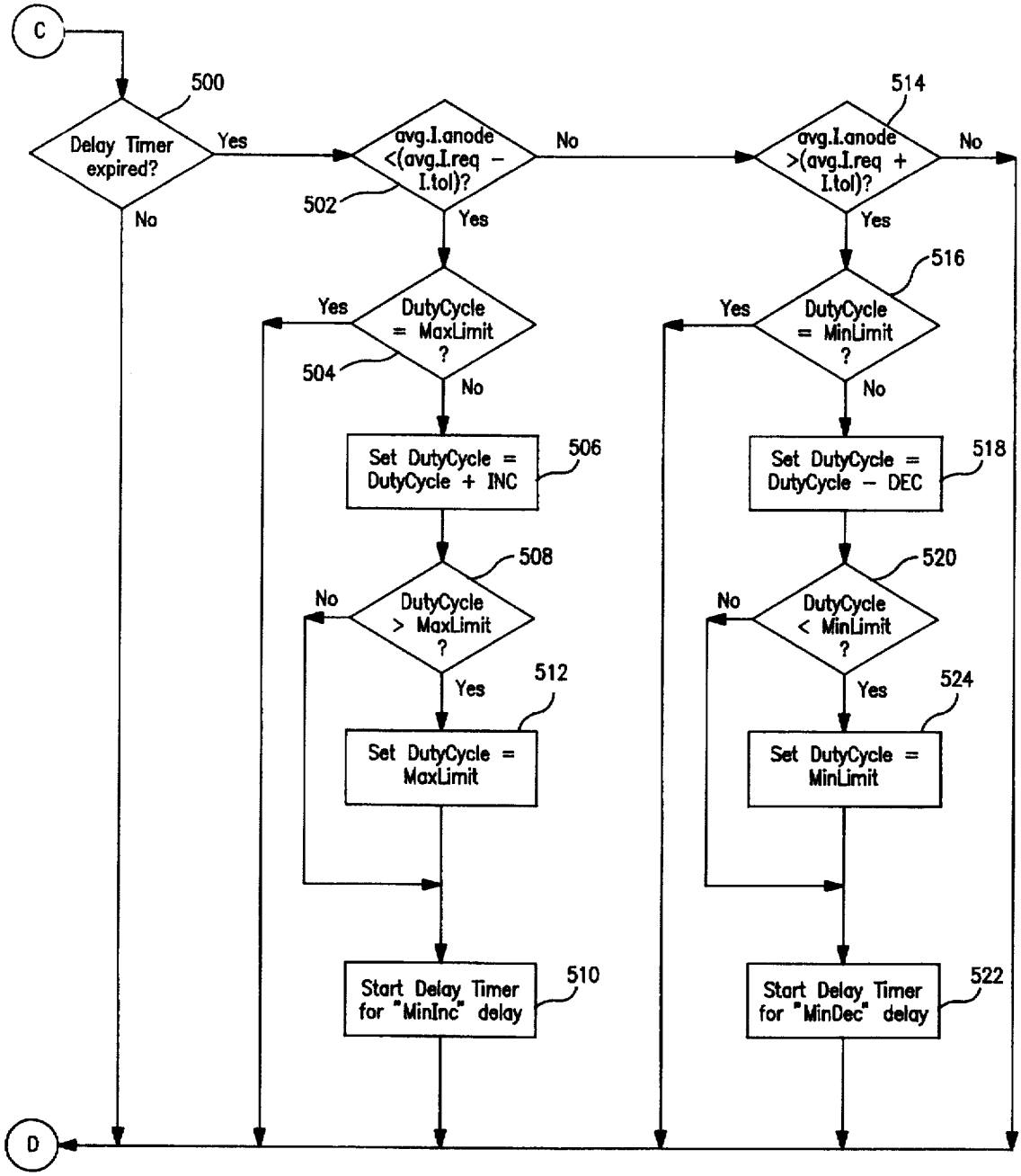
Figure 9A:
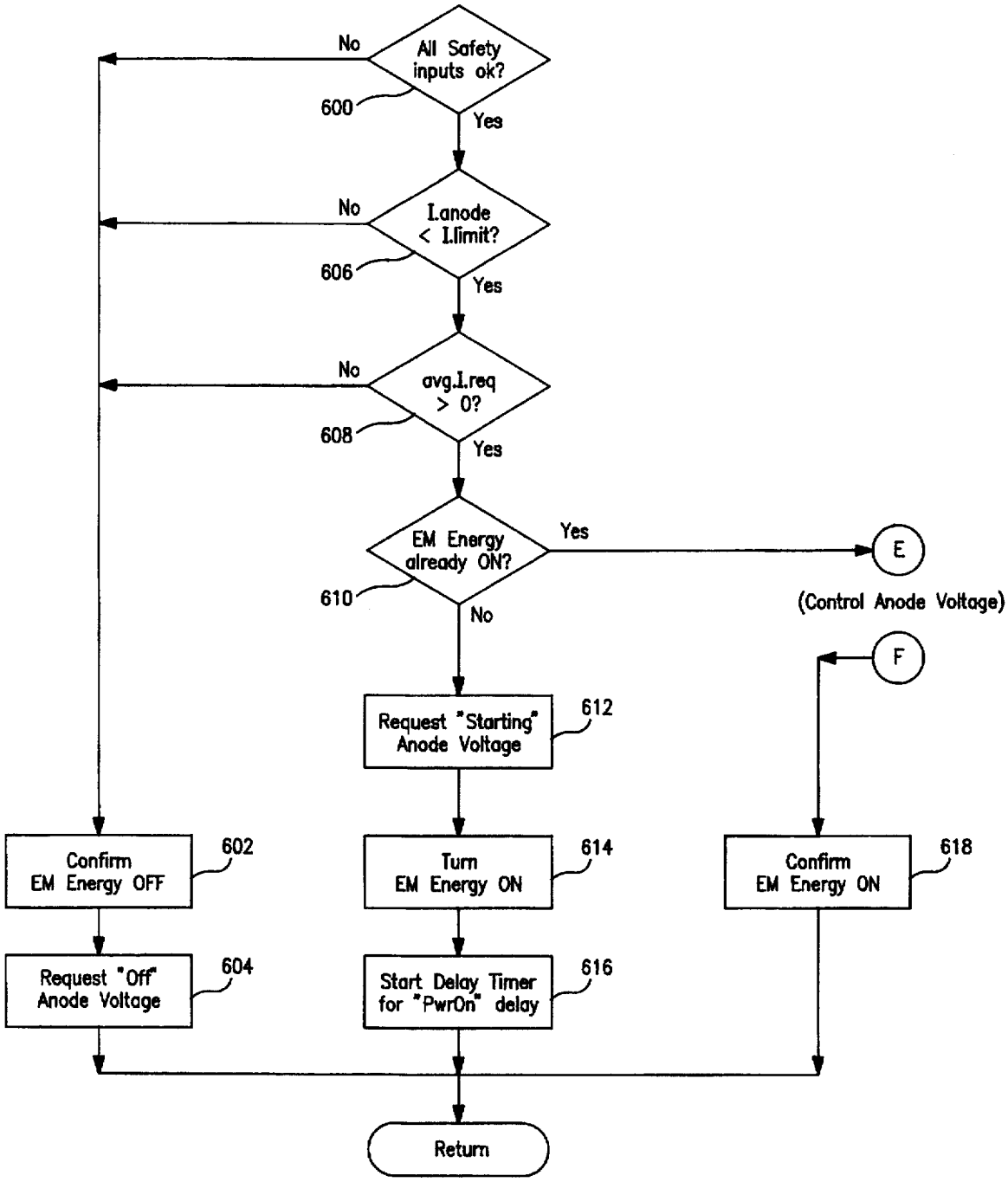
FIGS. 9*a* and 9*b* are flow charts depicting a process for controlling electromagnetic field strength in a dielectric oven using variable anode voltage.
Figure 9B:
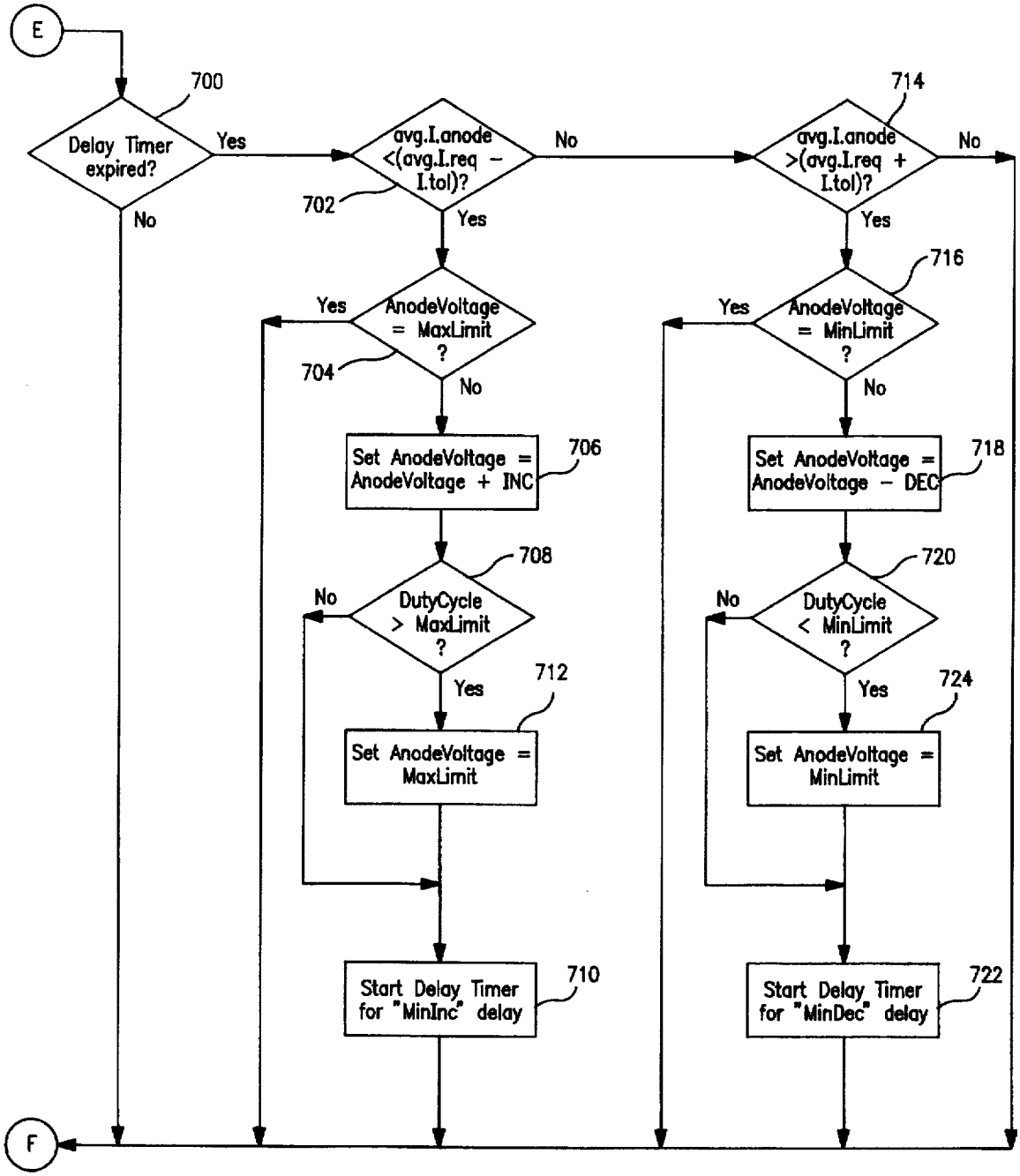

The flow charts of FIGS. 5–9 depict embodiments of a main control process logic loop (FIGS. 5*a* and 5*b*), a state routines flow chart (FIG. 6), a flow chart depicting electromagnetic energy output control using moveable capacitor plates and a related capacitor plate position control flow chart (FIGS. 7*a* and 7*b*), a flow chart depicting electromagnetic energy output control using duty-cycled grid blocking and a related flow chart for control of grid duty cycle (FIGS. 8*a* and 8*b*), and a flow chart depicting electromagnetic energy output control using variable anode voltage and a related flow chart for control of anode voltage (FIGS. 9*a* and 9*b*). The first of these figures shows a main loop, FIG. 5*a*, and an alternate main loop using cooking performance sensors, FIG. 5*b*. Referring to FIG. 5*a*, main loop A begins with a power-up and initialize operation 2. In this operation, various tasks may be performed. In general, however, power is supplied to microprocessor control board 40 and various internal diagnostic tests are performed. Power supply 20 and generator 22 are activated, and keyer 28 transmits the initial duty cycle to generator 22. Moreover, upper and lower motors 30*a* and 30*b* position the moveable capacitor plates to the "home" or power-up position. Finally, all sensors and measuring devices are zeroed, and diagnostic tests and internal checks are performed on control panel and displays 50.

After the control system has been powered-up and initialized, the state routines operation 3 is performed. This operation is described in greater detail in FIG. 6. State routines operation 3 involves the selection of the "Cook" or "Idle" state of operation for the control system. Generally, in the Cook state, the system heats products. In the Idle state, however, the system remains powered-up and initialized and ready to receive products or to commence or resume heating products already placed within the dielectric oven.

User input/output (I/O) operation 4 allows an operator to key inputs into the control system and to display system outputs using control panel and displays 50. In this operation, heating parameters, such as heating time, thaw time, or anode current for new products may be requested, or preprogrammed heating parameters may be requested by identifying the product type or the quantity of products to be heated, or both. In this operation, the number of heating levels to be utilized may also be input. For example, heating parameters may be input to instruct the oven to heat a foodstuff at a lower electromagnetic field strength for a prescribed period in order to gently defrost the foodstuff and then to gradually increase the electromagnetic field strength until a higher cooking intensity is reached.

In update inputs operation 5, the sensors and interlocks, i.e., door switches, are checked. This operation involves a status check of each sensor and interlock to insure that it is operational. Further, sensors, such as ammeter 14, may be read. Sensors also may be updated with new safety limits (I.limit) or tolerances (I.tol). Safety limits include limits on the amount of anode current which may be supplied to plates 13*a* or 13*b*. This prevents current overloads and overheating of the dielectric heating circuits. Further, such safety limits may protect the generator from short circuits. Tolerances may be input to the control system to prevent duty cycle, anode voltage, or plate distance adjustments as a result of insignificant variations or fluctuations in the capacitance.

Associated with update inputs operation 5 is condition error check operation 6. In this operation, errors identified during update inputs operation 5 may be corrected. Some error conditions may be due to improperly input updates. Other errors may be due to faulty sensors or interlocks. Diagnostic checks may be run on selected sensors and interlocks from condition error check operation 6. Some sensors or interlocks may be replaced while others experiencing programming problems may be corrected from control panel and displays 50.

Once operations 4, 5, and 6 have been completed and all sensors and interlocks have been checked and all heating parameters have been requested, input, or updated; electromagnetic energy output control operation 8 is performed. This operation is described in greater detail in FIGS. 7*a* and 7*b*, 8*a* and 8*b*, and 9*a* and 9*b*. The steps involved in operation 8 are dependent on the method of controlling the capacitance, e.g., using moveable capacitor plates (FIGS. 7*a* and 7*b*), using duty-cycled grid blocking (FIGS. 8*a* and 8*b*), or using variable anode voltage (FIGS. 9*a* and 9*b*). Once operation 8 has been completed, however, the other output update operation 9 which involves a status check of other control system outputs, such as lapsed heat time, may be completed.

Figure 5A:
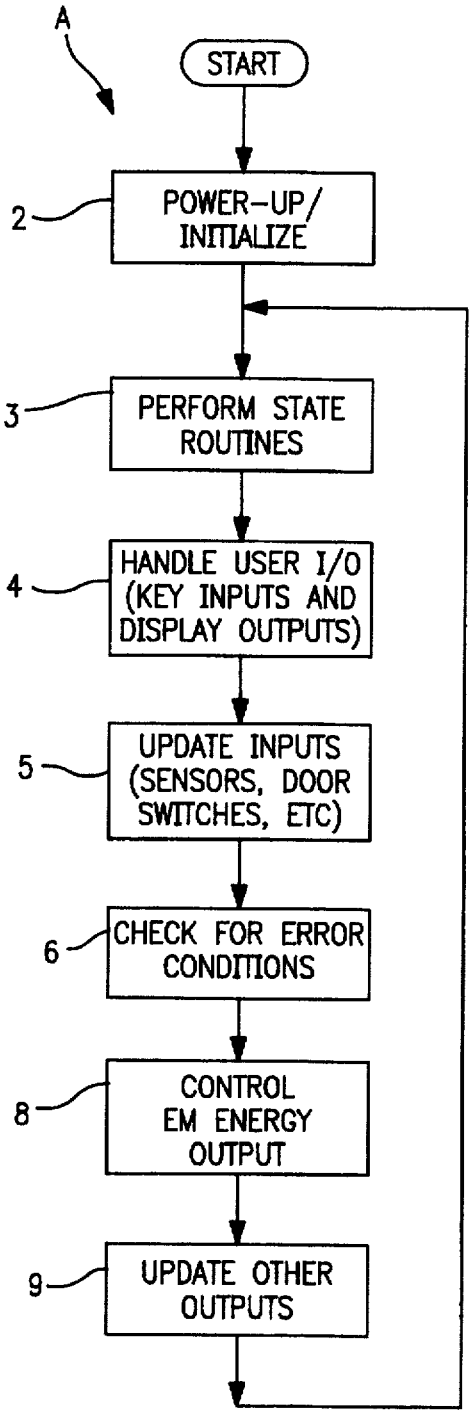
FIG. 5*a* is a flow chart depicting a main control loop of a process of the invention.
Figure 5B:
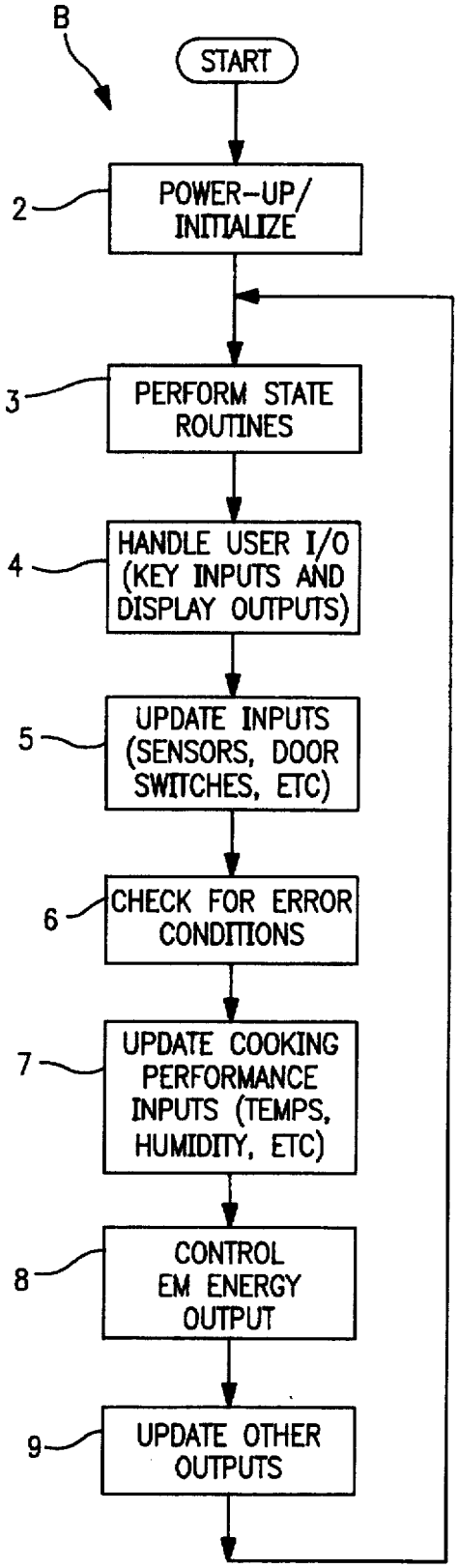
FIG. 5*b* is a flow chart of a main control loop of another embodiment of this invention employing heating performance monitoring sensors.

Referring to FIG. 5*b*, an alternative embodiment of the main loop B using cooking performance sensors is depicted. This main loop is essentially identical to main loop A depicted in FIG. 5*a*. Nevertheless, main loop B of FIG. 5*b* is intended for use with a dielectric oven equipped with cooking performance sensors. In the cooking performance input update operation 7, cooking performance sensors, such as temperature sensor(s) 16 and humidity sensor(s) 18, are provided with predetermined safety limits, such as high temperature or high humidity limits, and efficiency limits, such as an optimum temperature or optimum humidity curve profile. These limits allow the system to identify preferred, improper, or unsafe cooking performance conditions and to monitor the cooking performance of the dielectric oven when containing various products. With the exception of this operation, main loop B of FIG. 5*b* is identical to main loop A of FIG. 5*a*. Thus, in either main loop, when the update of other input operation 9 is complete, the system returns to perform state routines operation 3.

Figure 6:
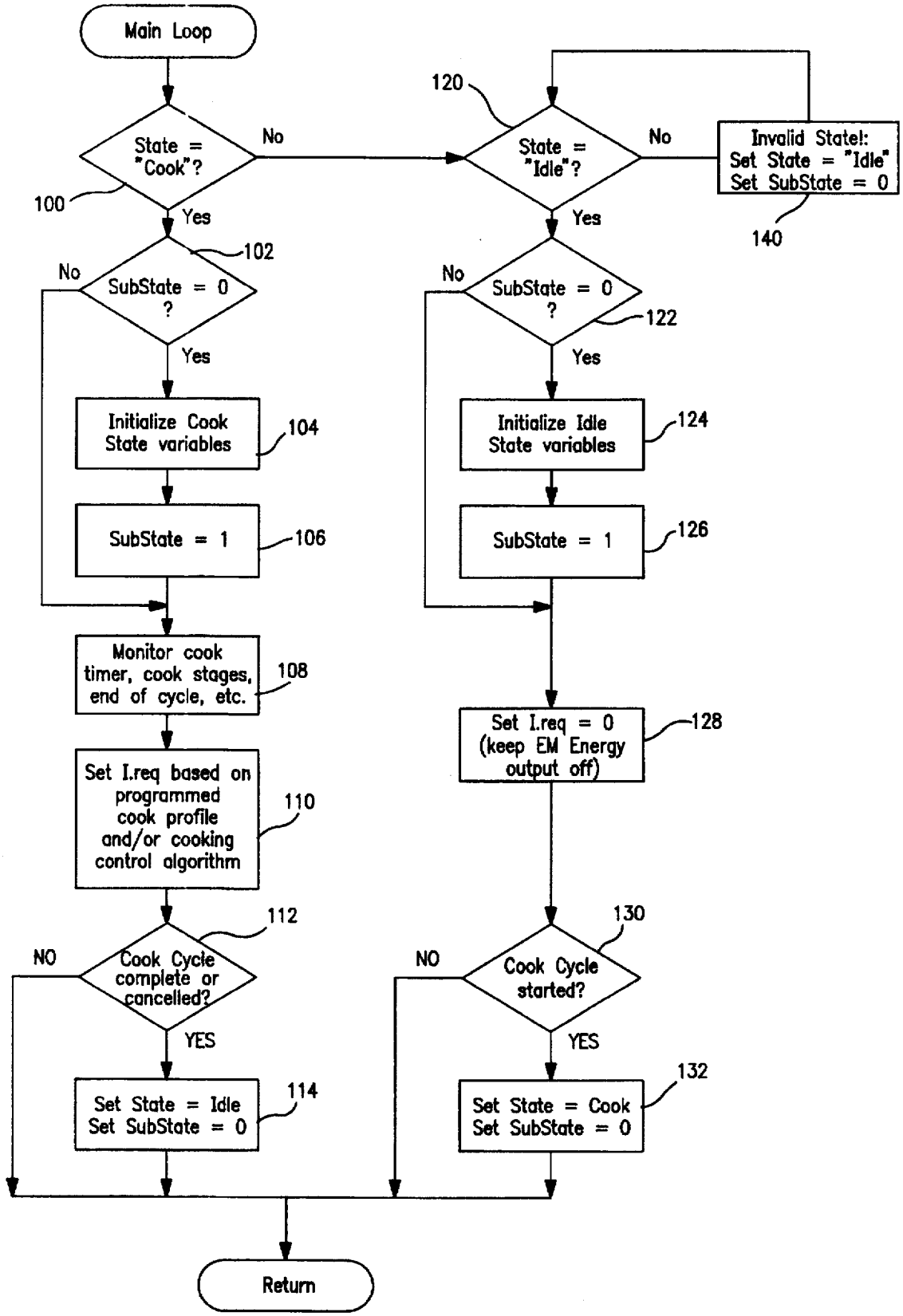
FIG. 6 is a flow chart depicting a heating state routine showing two alternative states for cooking foodstuffs: a Cook state and an Idle state.

Referring to FIG. 6, state routines performance operation 3 is depicted in greater detail. At step 100, the system determines whether it is in the Cook state. If the system is in the Cook state, the system determines whether the Cook state variables have been initialized. In step 102, the system determines whether the substate value equals zero (Substate=0). If the substate variable equals zero, no Cook state variables have been initialized, and the Cook state variables are then initialized, as indicated in step 104. Once the Cook state variables have been initialized, the substate value is set at 1 (Substate=1), as indicated in step 106. If, however, it is determined at step 102 that the substate value is not equal to zero (Substate=0), the state routines operation skips steps 104 and 106 and proceeds to step 108. In step 108, various cooking parameters, such as the cook timer, the cook stages for heating products in multiple stages, and the cook cycle for repetitive heating, are monitored.

In step 110, the requested anode current (Lreq) which is essentially a measure of requested electromagnetic energy output is set into the control system. This may be accomplished by microprocessor control board 40 retrieving heating parameters previously stored in its storage components, or new data or parameters may be input to a control system. Alternatively, a measure of electromagnetic energy output may be determined by microprocessor control board 40 using a heating parameters algorithm based on the type and quantity of product placed in the dielectric oven. During state routines operations, the control system determines whether the cook cycle has been completed or cancelled, as indicated in step 112. If the cook cycle has not been completed or cancelled, the control system returns to the main loop. However, if the cook cycle has been completed or cancelled, the control system first switches to the Idle state and requests initialization of Idle state variables by setting the substate value to zero (Substate=0) and then returning to the main loop.

If, however, it was determined at decision step 100 that the system is not in the Cook state, the control system proceeds to step 120 and determines whether the control system is in the Idle state. If as a result of steps 100 and 120, it is determined that the system is neither in the Cook state nor Idle state, the system is in an invalid or unidentified state. If the heating system does not recognize the state, the system defaults to the Idle state, as indicated in step 140. In addition, initialization of Idle state variables is requested by setting the substate value to zero (Substate=0).

Once it is determined that the system is in the Idle state, the control system determines in step 122 whether the substate value is set at zero. If the substate value is not already set at zero, the requested plate current is set to zero (Lreq=0) in step 128. This insures that no electromagnetic energy output occurs in the Idle state. If, however, the substate value already equals zero (Substate=0), the Idle state variables are initialized in step 124. After the Idle state variables have been initialized in step 124, the substate value is set to one (Substate=1) in step 126.

With the Idle state variables initialized and the requested plate current set at zero (Lreq=0), the system determines whether the cook cycle has started in step 130. If the cook cycle has not started, the state routines operation 3 is complete, and the control system returns to the main loop. If, however, the cook cycle has started, the state is reset to the Cook state, and the substate value is zeroed (Substate=0) in step 132 before the system returns to the main loop.

As discussed above, the electromagnetic energy output control operation utilized by the control system is determined by anode current. The electromagnetic field strength may be controlled by varying separation 62, i.e., the distance, between plates 13*a* and 13*b* (FIGS. 7*a* and 7*b*), by adjusting the duty cycle of generator 22 (FIGS. 8*a* and 8*b*), or by adjusting the anode voltage (FIGS. 9*a* and 9*b*).

EM Energy Output Using Moveable Plates

Referring to FIGS. 7*a* and 7*b*, the electromagnetic energy output control operation and the plate position control operation are depicted. In step 200 of FIG. 7*a*, it is first determined whether all safety inputs are satisfactory. In this step, the system determines whether all monitored values are within acceptable levels and whether all interlocks 76 are closed. Specifically, the system determines whether the temperature and humidity sensed by temperature sensor 16 and humidity sensor 18, respectively, are within acceptable ranges for cooking performance. If any of the safety outputs is unsatisfactory, the system confirms that electromagnetic energy output is off, as indicated in step 202. The control system then instructs motors 30a and 30b to place capacitor plates 13a or 13b in the "home" position of step 204. The "home" position for the plates may be the position at which the capacitance generated by the pair of capacitors is the minimum capacitance achievable using the moving plates. The system then returns to the main loop and continues main loop operations.

If all safety inputs are satisfactory, the system proceeds to step 206 in which it determines whether the anode current measured (I.anode) by ammeter 14 is less than the safety limit for anode current (I.limit). If the measured or actual anode current equals or exceeds the safety limit for anode current (I.anode≧I. limit), the system again confirms that electromagnetic energy output is off in step 202 and causes the capacitor plates to be placed in the "home" position of step 204. However, if the actual anode current is less than the safety as indicate node current (I.anode<I.limit), as indicated in step 208, the system next determines whether the requested anode current is greater than zero (I.req>0). If requested anode current is not greater than zero (I.req≦0), once again the system confirms that electromagnetic energy output is off, requests that the capacitor plates be placed in the "home" position, and returns to the main loop.

If requested anode current is greater than zero (I.req>0), the control system determines whether electromagnetic energy output has already been turned on, as indicated in step 210. If electromagnetic energy output is not on, the system determines in step 212 whether the plates are in the "home" position. If electromagnetic energy output is not on and the plates are not in the "home" position, again, the control system confirms that electromagnetic energy output is off and places the plates in the "home" position. Nevertheless, if the plates are in the "home" position of step 212, the system turns electromagnetic energy output on, as indicated in step 214, and starts the delay timer for the "power on" (PwrOn) delay as indicated in step 216.

The "power on" delay insures that the control algorithm does not react until transient effects of turning the generator on or moving the capacitor plates have subsided. It also prevents damage to the system from occurring when the generator is turned on and immediately turned off. The delay requires that the generator be turned on for some minimum period of time, e.g., about 0.5 seconds, to insure that the generator is not damaged by rapid on/off shifting. Preferably, all of the electrical or electromechanical components of the control system are equipped with such delays. While these delays are not necessary for the operation of the system, they improve its longevity.

If the system determines in step 210 that electromagnetic energy output is already on, the system proceeds to the plate position control operation depicted in FIG. 7b. In step 300 of FIG. 7b, the system determines whether the plates are being moved forward by motors 30a or 30b. If the plates are being moved forward, the system determines in step 302 whether the plates are at their forward limit. The forward limit is the plate separation at which the greatest capacitance is generated between a pair of capacitors in a dielectric heating circuit. If the plates are at their forward limit, the system stops the plates forward movement, as indicated in step 304, and starts the delay timer for the "minimum stop" (MinStop) delay of step 306. As mentioned above, whenever an electrical or electromechanical component is stopped or started, a delay timer may be started to insure that the component is not damaged by rapidly activating and deactivating it. After the "minimum stop" delay has been initiated, the system returns to the electromagnetic energy output control operation of FIG. 7a.

If, however, the system determines in step 302 that the plates are not at their forward limit, the system then determines whether any delay timer has expired, as indicated in step 308. If the delay timer has not expired, the system returns to the electromagnetic energy output control operation of FIG. 7a and confirms, as indicated in step 218, that electromagnetic energy output is still on. Nevertheless, if the delay timer has expired, the system proceeds to step 310 and determines whether the measured anode current is greater than or equal to the requested anode current (I.anode≧I.req). If the actual anode current equals or exceeds the requested anode current, the control system proceeds to step 304 and stops the forward movement of the plates. However, if actual anode current does not equal or exceed requested anode current (I.anode<I.req), the system returns to the electromagnetic energy output control operation and confirms in step 218 that electromagnetic energy output remains on.

If the plates are not moving forward, the control system determines whether the plates are moving in reverse, as indicated in step 312. If the plates are moving in reverse, the system determines whether the plates have reached their reverse limit. See step 314. If the plates are at the reverse limit, the control system stops the plates, as indicated in step 304, and starts the delay timer for the "minimum stop" delay. The reverse limit is the opposite of the forward limit. It is the plate separation at which the least capacitance is generated between a pair of capacitors in a dielectric heating circuit.

Nevertheless, if the plates are not at the reverse limit, the control system proceeds to step 316 and determines whether the delay timer has expired. Again if the delay timer has not expired, the system returns to the electromagnetic energy output control operation and confirms that electromagnetic energy output is still on. If, however, the delay timer has expired, the system determines whether actual plate current is less than or equal to requested anode current (I.anode≦I.req). If actual anode current is less than or equal to requested plate current, the system stops the reverse movement of the plates and starts the delay timer for minimum stop delay. If actual anode current is greater than requested anode current (I.anode>I.req), the system returns to the electromagnetic energy output control operation and confirms that the electromagnetic energy output remains on.

If the control system determines that the plates are neither moving forward nor reversed, the plates are stopped, as indicated in step 320. While the control system may determine that the plates are neither stopped nor moving, this is an invalid system mode, as indicated in step 322, and the system instructs the plates to stop and starts the "minimum stop" delay timer. When such an invalid mode is detected, the system returns to the electromagnetic energy output control operation and confirms that electromagnetic energy output remains on.

Nevertheless, once the plates are stopped, the system proceeds to step 324 and determines whether the delay timer has expired. As discussed above, if the delay timer has not expired, the system returns to the electromagnetic energy output control operation and confirms that electromagnetic energy output is still on. If, however, the delay timer has expired, the system determines whether the actual anode current is less than the requested anode current less some acceptable tolerance (I.anode<I.req−I.tol). This acceptable tolerance of step 326 is an amount that reflects deviations that are small enough, such that plate position adjustments are not desirable. If the actual anode current is less than the requested current minus the acceptable tolerance, the system determines whether the plates are at the forward limit, as indicated in step 328. If the plates are at the forward limit, the system returns to the electromagnetic energy output control operation and confirms that electromagnetic energy output is still on.

If the plates are not at the forward limit, however, the system instructs the motor(s) to move the plates forward, as indicated in step 330, and starts the delay timer for the "minimum forward" (MinFwd) delay. If actual anode current is not less than requested anode current minus the acceptable tolerance (I.anode≧I.req−I.tol), the system determines whether actual anode current is greater than requested anode current plus the acceptable tolerance (I.anode>I.req+I.tol). If actual anode current is neither less than requested anode current minus the acceptable tolerance or greater than actual anode current plus the acceptable tolerance, as indicated in steps 326 and 324, the system returns to the electromagnetic energy output control operation and confirms that electromagnetic energy output is still on. If actual anode current is greater than requested anode current plus an acceptable tolerance (I.anode>I.req+I.tol), the system determines whether the plates are at the reverse limit, as indicated in step 336. If the plates are at their reverse limit, the system returns to the electromagnetic energy output control operation and confirms that electromagnetic energy output is still on. However, if the plates are not at their reverse limit, the system instructs the motor(s) to move the plates in the reverse direction, as indicated in step 338. The system also starts the delay timer for the "minimum reverse" (MinRev) delay.

EM Energy Output Using Duty-Cycle Grid Blocking

The system may use duty-cycled grid blocking to adjust average power of a generator, as disclosed in FIGS. 8*a* and 8*b*. In this embodiment, the system again checks to insure that all safety inputs are satisfactory in step 400 of FIG. 8*a*. As described above, safety inputs include all heating performance parameters and oven interlocks 76. If all safety inputs are not satisfactory, the system confirms that electromagnetic energy output has been turned off, as indicated in step 402. Further, the system requests the "off" grid duty cycle, as indicated in step 404. The "off" grid duty cycle is equivalent to a zero percent duty cycle. The duty cycle measures the output on the grid blocking circuit. When a zero percent duty cycle is initiated, the grid is blocked, and energy is not applied to the product. Conversely, at a 100 percent duty cycle, the grid is completely unblocked, and full power is applied to the product.

If all safety inputs are satisfactory, the system next determines whether the actual anode current is less than the safety limit for anode current (I.anode<I.limit), as indicated in step 406. Once again, if the actual current is greater than or equal to the safety limit for anode current (I.anode≧I.limit), the system confirms that electromagnetic energy output is off and initiates the "off" grid duty cycle. If actual anode current is less than the safety limit for anode current, however, the system determines whether a requested average anode current is greater than zero (avg.I.req>0). If the requested average anode current is less than or equal to zero (avg.I.req≦0), the system again confirms that electromagnetic energy output is off and initiates the "off" grid duty cycle, as indicated in steps 402 and 404. If the average requested anode current is greater than zero (avg.I.req>0), however, the system determines whether electromagnetic energy output is already on, step 410. If electromagnetic energy output is not on, the system proceeds to step 412 and initiates the "starting" grid duty cycle. The system then turns electromagnetic energy output on and starts the delay timer for the "power on" (PwrOn) delay.

Returning to step 410, if electromagnetic energy output is already on, the system proceeds to the grid cycle control operation depicted in FIG. 8*b*. Initially, the control system determines whether the delay timer has expired, as indicated in step 500. If the delay timer has not expired, the system returns to the electromagnetic energy output control operation and confirms that electromagnetic energy output remains on. If, however, the delay timer has expired, the system proceeds to step 502 and determines whether an actual average anode current is less than the requested average anode current minus an acceptable tolerance (avg.I.anode<avg.I.req−I.tol). If the actual average anode current is less than the requested average anode current minus an acceptable tolerance, the system determines whether the duty cycle equals the "maximum duty cycle limit"(MaxLimit) as indicated in step 504. The maximum limit may be the 100 percent duty cycle or the full power transmission duty cycle. Alternatively, an additional safety factor may be built into the grid duty cycle determination. For example, the maximum limit may be set at about 80 percent duty cycle to protect the anode from current overload.

If the system determines in step 504 that the duty cycle equals the maximum limit, the system returns to the electromagnetic energy output control operation and confirms that electromagnetic energy output is on. However, if duty cycle is less than the maximum limit, the duty cycle is increased, so as to approach the maximum limit. Nevertheless, if after being increased, the duty cycle exceeds the maximum limit, it is decreased to equal the maximum limit (MaxLimit), as indicated in step 512. On the other hand, if the duty cycle is not greater than the maximum limit, the start delay timer for the "minimum duty cycle increase" (MinInc) delay is initiated, as shown in step 510, and the system returns to the electromagnetic energy output control operation.

If the actual average anode current is greater than or equal to the requested average anode current minus an acceptable tolerance (avg.I.anode≧avg.I.req−I.tol), the system proceeds to step 514 and determines whether the actual average anode current is greater than the requested average anode current plus an acceptable tolerance (avg.I.anode>avg.I.req+I.tol). If the actual average anode current is neither less than the requested average anode current minus an acceptable tolerance nor greater than a requested average anode current plus an acceptable tolerance, the system returns to the electromagnetic energy output control operation and confirms that the electromagnetic energy output is still on. However, if the actual average anode current is greater than the requested average anode current plus an acceptable tolerance (avg.I.anode>avg.I.req+I.tol), the system determines whether the duty cycle equals the minimum limit. As with the maximum limit, the minimum limit may be a zero percent duty cycle which keeps the grid blocked, so that energy is not applied to the product. Alternatively, however, it may be something greater than a zero percent duty cycle, such as an about 20 percent duty cycle, so that some energy is generated to allow the heating process to continue. This may prevent cooling of the product when the generator is operating at the minimum limit.

If the duty cycle equals the minimum limit, the system returns to the electromagnetic energy output control operation and confirms that the electromagnetic energy output is on. However, if the duty cycle is greater than the minimum limit, the system decreases the duty cycle, as indicated in step 518, to reduce the duty cycle toward the minimum limit. If after this decrease in the duty cycle, the duty cycle is less than the minimum limit, as indicated in step 520, the system proceeds to step 524 and sets the duty cycle equal to the minimum limit (MinLimit). If, however, it is determined in step 520 that the duty cycle is greater than or equal the minimum limit, the system proceeds to step 522 and starts the delay timer for the "minimum duty cycle decrease" (MinDec). Whether the duty cycle is greater than or equal to the minimum limit after steps 520 and 524, the start delay is initiated, and the system returns to the electromagnetic energy output control operation and confirms that electromagnetic energy output is still on before returning to the main loop.

EM Energy Output Using Variable Anode Voltage

The system may use anode voltage control to adjust the average power, as disclosed in FIGS. 9*a* and 9*b*. In this embodiment, the system again checks to insure that all safety inputs are satisfactory in step 600 of FIG. 9*a*. As described above, safety inputs include all heating performance parameters and oven interlocks 76. If all safety inputs are not satisfactory, the system confirms that electromagnetic energy output has been turned-off, as indicated in step 602. Further, the system requests the "off" anode voltage, as indicated in step 604. The "off" anode voltage is equivalent to a zero anode voltage. When a zero anode voltage is initiated, energy is not applied to the product.

If all safety inputs are satisfactory, the system next determines whether the actual anode current is less than the safety limits of anode (I.anode<I.limit), as indicated in step 606. Once again, if the actual anode current is greater than or equal to the safety limit for anode current (I.anode>I.limit), the system confirms that the electromagnetic energy output is off and initiates the "off" anode voltage. If actual anode current is less than the safety limit for anode current, however, the system determines whether a requested average anode current is greater than zero (avg.I.req>0). If the requested average anode current is less than or equal to zero (avg. Lreq≦0), the system again confirms that electromagnetic energy output is off and initiates the "off" plate voltage, as indicated in steps 602 and 604. If the average requested anode current is greater than zero (avg.I.req>0), however, the system determines whether electromagnetic energy output is already on, step 610. If electromagnetic energy output is not on, the system proceeds to step 612 and initiates the "starting" anode voltage. The system then raises anode voltage until electromagnetic energy is detected and starts the delay timer for the "power on" (PwrOn) delay.

Returning to step 610, if electromagnetic energy is already on, the system proceeds to the anode voltage control operation depicted in FIG. 9*b*. Initially, the control system determines whether the delay timer has expired, as indicated in step 700. If the delay timer has not expired, the system returns to the electromagnetic energy output control operation and confirms that electromagnetic energy output remains on. If, however, the delay timer has expired, the system proceeds to step 702 and determines whether the actual average anode current is less than the requested average anode current minus an acceptable tolerance (avg.I.anode<avg.I.req−I.tol). If the actual average anode current is less than the requested average anode current minus an acceptable tolerance, the system determines whether the anode voltage equals the "maximum anode voltage" limit (MaxLimit) as indicated in step 704. The maximum limit may be the maximum voltage obtainable from the power supply or, alternatively a limit with a built in safety factor to protect the anode from over-voltage conditions.

If the system determines in step 704 that the anode voltage equals the maximum limit, the systems returns to the electromagnetic energy output control operation and confirms that electromagnetic energy output is on. However, if the anode voltage is less than the maximum limit, the anode voltage is increased, as indicated in step 706, so as to approach the maximum limit. Nevertheless, if after being increased, the anode voltage exceeds the maximum limit, as indicated in step 708, the anode voltage is decreased to equal the maximum limit, as indicated in step 712. On the other hand, if the anode voltage is less than or equal to the maximum limit, the system proceeds to step 710 and starts the delay timer for the "minimum anode voltage increase" (MinInc), and the system returns to the electromagnetic energy output control operation.

If the actual average anode current is greater than or equal to the requested average anode current minus an acceptable tolerance (avg.I.anode≧avg.I.req−I.tol), the system proceeds to step 714 and determines whether the actual average anode current is greater than the requested average anode current plus an acceptable tolerance (avg.I.anode>avg.I.req+I.tol). If the actual average anode current is neither less than the requested average anode current minus an acceptable tolerance nor greater than a requested average anode current plus an acceptable tolerance, the system returns to the electromagnetic energy output control operation and confirms that the electromagnetic energy is still on. However, if the actual average anode current is greater than the requested average anode current plus an acceptable tolerance (avg.I.anode>avg.I.req+I.tol), the system determines whether the anode voltage equals the minimum limit (MinLimit). As with the maximum limit, the minimum limit may be zero anode voltage, so that energy is not applied to the product. Alternatively, however, it may be something greater than zero, such as 50 percent of the maximum anode voltage, so that some energy is generated and the heating process allowed to continue. This may prevent cooling of the product when the generator is operating at the minimum limit.

If the anode voltage equals the minimum limit in step 716, the system returns to the electromagnetic energy output control operation and confirms that the electromagnetic energy output is on. However, if the anode voltage is greater than the minimum limit, the system decreases the anode voltage, as indicated in step 718, to reduce the anode voltage toward the minimum limit. If after this decrease in the anode voltage, the anode voltage is less than the minimum limit, as indicated in step 720, the system proceeds to step 724 and sets the anode voltage equal to the minimum limit. If, however, it is determined in step 720 that the anode voltage is greater than or equal the minimum limit, the system proceeds to step 722 and starts the delay timer for the "minimum anode voltage decrease" (MinDec). Whether the anode voltage is greater than or equal to the minimum limit after steps 720 and 724, the start delay is initiated, and the system returns to the electromagnetic energy output control operation and confirms that electromagnetic energy is still on before returning to the main loop.

Although a detailed description of the present invention has been provided above it is to be understood that the scope of the invention is not to be limited thereby, but is to be determined by the claims which follow.

We claim:

1. A control system for controlling the heating of a product in a dielectric oven, comprising:

at least one dielectric heating circuit including an electromagnetic energy source having an anode operating at a frequency determined by at least one inductor and electrically connected to a pair of capacitors, wherein each capacitor includes two capacitor plates and at least one of said capacitor plates is moveable, such that said pair of capacitors forms a variable capacitor in which said product to be heated is a dielectric;

at least one ammeter, electrically connected to said anode, for measuring actual current at said anode;

a motor, mechanically connected to at least one of the plates of at least one of said capacitor, for continuously increasing or decreasing a distance between the plates of said capacitor, thereby adjusting the electromagnetic energy applied to said product; and a processor, connected to said at least one ammeter and said motor, for receiving ammeter measurements whereby the distance between said pair of capacitor plates is determined; for receiving, storing, and retrieving a requested anode current; for comparing the requested anode current to the actual anode current to determine whether to increase or decrease the distance between the plates of at least one of said capacitors thereby increasing or decreasing said actual anode current; and for instructing said motor to adjust said distance between said plates.

2. The control system of claim 1, wherein said electromagnetic energy source has an anode voltage adjusted by a voltage control device and said processor is connected to said voltage control device and includes a timer, whereby actual average anode current is determined and said processor receives, stores, and retrieves a requested anode current and compares said requested average anode current to the actual average anode current to determine whether to increase or decrease the anode voltage and thereby increase or decrease said actual average anode current.

3. The control system of claim 1, wherein said processor is connected to said electromagnetic energy source and deactivates said electromagnetic energy source when the actual anode current exceeds a safety limit for anode current.

4. The control system of claim 1, wherein said oven has at least one intake port and at least one exhaust port and a thermometer monitors the heating of the product by measuring a temperature difference between said at least one intake and said at least one exhaust port and transmits said temperature difference to said processor.

5. The control system of claim 1, wherein said oven has at least one intake port and at least one exhaust port and a thermometer monitors the heating of the product by measuring a temperature change over time at said at least one exhaust port and transmits said temperature change to said processor.

6. The control system of claim 1, wherein said oven has at least one intake port and at least one exhaust port and a humidity sensor monitors the heating of the product by measuring a humidity difference between said at least one intake and said at least one exhaust port and transmits said humidity difference to said processor.

7. The control system of claim 1, wherein said oven has at least one intake port and at least one exhaust port and a humidity sensor monitors the heating of the product by measuring a humidity change over time at said at least one exhaust port and transmits said humidity change to said processor.

8. The control system of claim 1, wherein said product is heated in a tray filled with a heating fluid and a tray thermometer monitors the heating of the product by measuring a temperature of said heating fluid and transmits said temperature to said processor.

9. The control system of claim 1, wherein said processor is a microprocessor.

10. The control system of claim 1 further comprising a data entry device for inputting a product and product heating parameters to said processor and wherein said processor includes a data storage component for receiving, storing, and selectively retrieving heating parameters for a plurality of products.

11. The control system of claim 1, wherein said electromagnetic energy source includes a triode vacuum tube.

12. A control system for controlling the heating of a product in a dielectric oven, comprising:

at least one dielectric heating circuit including an electromagnetic energy source having an anode and a selectable duty cycle operating at a frequency determined by at least one inductor and electrically connected to at least a pair of capacitors, wherein each capacitor includes two capacitor plates, such that each pair of capacitors forms a variable capacitor in which said product to be heated is a dielectric;

at least one ammeter electrically connected to said anode for measuring an actual current at said anode;

a keying device connected to said electromagnetic energy source for adjusting said duty cycle;

a processor, including a timer and connected to said ammeter and said keying device, for receiving ammeter measurements, whereby the actual average anode current is determined; for receiving, storing, and retrieving a requested average anode current; for comparing said requested average anode current to said actual average anode current to determine whether to increase or decrease said duty cycle thereby increasing or decreasing said actual average anode current; and for instructing said keying device to adjust said duty cycle.

13. The control system of claim 12, wherein said electromagnetic energy source has an anode voltage adjusted by a voltage control device and said processor is connected to said voltage control device, whereby actual average anode current is determined and said processor receives, stores, and retrieves a requested anode current and compares said requested average anode current to the actual average anode current to determine whether to increase or decrease the anode voltage and thereby increase or decrease said actual average anode current.

14. The control system of claim 12, wherein said processor is connected to said electromagnetic energy source and deactivates said electromagnetic energy source when the actual average anode current exceeds a safety limit for anode current.

15. The control system of claim 12, wherein and at least one exhaust port intake port and at least one exhaust port and a thermometer monitors the heating of the product by measuring a temperature difference between said at least one intake and said at least one exhaust port and transmits said temperature difference to said processor.

16. The control system of claim 12, wherein said oven has at least one intake port and at least one exhaust port and a thermometer monitors the heating of the product by measuring a temperature change over time at said at least one exhaust port and transmits said temperature change to said processor.

17. The control system of claim 12, wherein said oven has at least one intake port and at least one exhaust port and a humidity sensor monitors the heating of the product by measuring a humidity difference between said at least one intake and said at least one exhaust port and transmits said humidity difference to said processor.

18. The control system of claim 12, wherein said oven has at least one intake port and at least one exhaust port and a humidity sensor monitors the heating of the product by measuring a humidity change over time at said at least one exhaust port and transmits said humidity change to said processor.

19. The control system of claim 12, wherein said product is heated in a tray filled with a heating fluid and a thermometer monitors the heating of the product by measuring a temperature of said heating fluid and transmits said temperature to said processor.

20. The control system of claim 12, wherein said processor is a microprocessor.

21. The control system of claim 12 further comprising a data entry device for inputting a product and product heating parameters to said processor and wherein said processor includes a data storage component for receiving, storing, and selectively retrieving heating parameters for a plurality of products.

22. A control system for controlling the heating of a product in a dielectric oven, comprising:

at least one dielectric heating circuit including an electromagnetic energy source having an anode operating at a frequency determined by at least one inductor and electrically connected to at least a pair of capacitors, wherein each capacitor includes two capacitor plates and one of said capacitor plates is moveable, such that each pair of capacitors forms a variable capacitor in which said product to be heated is a dielectric;

at least one ammeter electrically connected to said anode for measuring actual current at said anode;

a voltage control device for controlling a first voltage provided to a power supply, said power supply providing an anode voltage at said anode; and a processor, including a timer and connected to said at least one ammeter and said voltage control device, for receiving ammeter measurements, whereby the actual average anode current is determined; for receiving, storing, and retrieving a requested average anode current; for comparing said requested average anode current to said actual average anode current to determine whether to increase or decrease said anode voltage thereby increasing or decreasing the actual average anode current; and for instructing said voltage control device to adjust said anode voltage whereby said actual average anode current is adjusted.

23. The control system of claim 22, wherein said electromagnetic energy source includes a triode vacuum tube.

24. The control system of claim 22, wherein said processor is connected to said electromagnetic energy source and deactivates said electromagnetic energy source when the actual anode current exceeds a safety limit for anode current.

25. The control system of claim 22, wherein said oven has at least one intake port and at least one exhaust port and a thermometer monitors the heating of the product by measuring a temperature difference between said at least one intake and said at least one exhaust port and transmits said temperature difference to said processor.

26. The control system of claim 22, wherein said oven has at least one intake port and at least one exhaust port and a thermometer monitors the heating of the product by measuring a temperature change over time at said at least one exhaust port and transmits and temperature change to said processor.

27. The control system of claim 22, wherein said oven has at least one intake port and at least one exhaust port and a humidity sensor monitors the heating of the product by measuring a humidity difference between said at least one intake and said at least one exhaust port and transmits said humidity difference to said processor.

28. The control system of claim 22, wherein said oven has at least one intake port and at least one exhaust port and a humidity sensor monitors the heating of the product by measuring a humidity change over time at said at least one exhaust port and transmits said humidity change to said processor.

29. The control system of claim 22, wherein said product is heated in a tray filled with a heating fluid and a tray thermometer monitors the heating of the product by measuring a temperature of said heating fluid and transmits said temperature to said processor.

30. The control system of claim 22, wherein said processor is a microprocessor.

31. A process of controlling the heating of a product in a dielectric oven comprising, an electromagnetic energy source having an anode, a resonant circuit including at least one inductor and a pair of capacitors electrically connected to said energy source, wherein each of said capacitors has a pair of capacitor plates and said product is located between said pair of capacitors, and a processor connected to said energy source and said resonant circuit, comprising the steps of:

requesting an anode current for the electromagnetic energy source;

measuring an actual anode current of the electromagnetic energy source during heating;

comparing said requested anode current to said actual anode current to determine whether to increase or decrease a distance between said pair of capacitor plates, thereby increasing or decreasing said actual anode current; and adjusting said distance continuously between said pair of capacitor plates.

32. The process of claim 31 further comprising the steps of:

selecting an anode voltage for the electromagnetic energy source;

determining an actual average anode current and a requested average anode current;

comparing said requested average anode current to said actual average anode current to determine whether to increase or decrease said anode voltage, thereby increasing or decreasing said actual average anode current; and adjusting said anode voltage for the electromagnetic energy source.

33. The process of claim 31 further comprising the steps of: comparing the actual anode current to a safety limit for anode current and deactivating said electromagnetic energy source when the actual anode current exceeds said safety limit.

34. The process of claim 31 further comprising the steps of: monitoring at least one heating performance sensor to measure product heating; and confirming whether to increase or decrease the actual anode current.

35. A process of controlling the heating of a product in a dielectric oven comprising an electromagnetic energy source having an anode and a selectable duty cycle, a resonant circuit including at least one inductor and at least a pair of capacitors, which are electrically connected to said energy source, wherein each of said capacitors has a pair of capacitor plates and said product is located between at least said pair of capacitors, and a processor connected to said energy source and said resonant circuit, comprising the steps of:

measuring an anode current of the electromagnetic energy source during heating;

selecting a duty cycle for said electromagnetic energy source;

determining an actual average anode current and a requested average anode current;

comparing said requested average anode current to said actual average anode current to determine whether to increase or decrease said duty cycle thereby increasing or decreasing said actual average anode current; and adjusting said duty cycle of the electromagnetic energy source during heating.

36. The process of claim 35 further comprising the steps of:

selecting an anode voltage for the electromagnetic energy source;

determining an actual average anode current and a requested average anode current;

comparing said requested average anode current to said actual average anode current to determine whether to increase or decrease said anode voltage, thereby increasing or decreasing said actual average anode current; and adjusting said anode voltage of the electromagnetic energy source during heating.

37. The process of claim 35 further comprising the steps of:

comparing said actual anode current to a safety limit for anode current; and deactivating said electromagnetic energy source when said actual anode current exceeds said safety limit.

38. The process of claim 35 further comprising the steps of:

monitoring at least one heating performance sensor to measure product heating; and confirming whether to increase or decrease said actual average anode current.

39. A process of controlling the heating of a product in a dielectric oven comprising an electromagnetic energy source having an anode, a voltage control device for adjusting a voltage provided to said anode, a resonant circuit including at least one inductor and at least a pair of capacitors, which are electrically connected to said energy source, wherein each of said capacitors has a pair of capacitor plates and said product is located between at least said pair of capacitors, and a processor connected to said energy source, said voltage control device, and said resonant circuit, comprising the steps of:

measuring an anode current of the electromagnetic energy source during heating;

selecting said anode voltage for the electromagnetic energy source;

determining an actual average actual anode current and a requested average anode current;

comparing said requested average anode current to said actual average anode current to determine whether to increase or decrease said anode voltage thereby increasing or decreasing said actual average anode current; and adjusting said anode voltage of the electromagnetic energy source during heating.

40. The process of claim 39 further comprising the steps of:

comparing said actual anode current to a safety limit for anode current; and deactivating said electromagnetic energy source when said actual anode current exceeds said safety limit.

41. The process of claim 39 further comprising the steps of:

monitoring at least one heating performance sensor to measure product heating; and confirming whether or to increase or decrease said actual average anode current.

* * * * *

UNITED STATES PATENT AND TRADEMARK OFFICE

CERTIFICATE OF CORRECTION

PATENT NO. : 5,695,671

DATED : December 9, 1997

INVENTOR(S) : Tim A. LANDWEHR et al.

It is certified that error appears in the above-identified patent and that said Letters Patent is hereby corrected as shown below:

On the title page, item:

--[73] Assignee: Henny Penny Corporation, Eaton, Ohio --

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*